US007804460B2

(12) United States Patent
Lee et al.

(10) Patent No.: US 7,804,460 B2
(45) Date of Patent: Sep. 28, 2010

(54) COMPLEX ELEMENTS FOR ANTENNA OF RADIO FREQUENCY REPEATER AND DIPOLE ARRAY CIRCULAR POLARIZATION ANTENNA USING THE SAME

(75) Inventors: Eung-Hyun Lee, Seoul (KR); Cheol-Hoo Kim, Seongnam (KR); Young-Chan Yoon, 102-301, Hyundai Apt. 785-1 bunji, Daerim 3-dong, Yeongdeungpo-gu, Seoul (KR) 150-765

(73) Assignees: MTI Co., Ltd., Seoul (KR); Young-Chan Yoon, Seoul (KR)

( * ) Notice: Subject to any disclaimer, the term of this patent is extended or adjusted under 35 U.S.C. 154(b) by 205 days.

(21) Appl. No.: 12/199,905

(22) Filed: Aug. 28, 2008

(65) Prior Publication Data

US 2009/0058752 A1 Mar. 5, 2009

(30) Foreign Application Priority Data

Aug. 28, 2007 (KR) ..... 10-2007-0086466

(51) Int. Cl.
*H01Q 21/26* (2006.01)

(52) U.S. Cl. ..... 343/797; 343/798; 343/810

(58) Field of Classification Search ..... 343/797, 343/798, 810, 817, 818, 819
See application file for complete search history.

(56) References Cited

U.S. PATENT DOCUMENTS

| | | | | |
|---|---|---|---|---|
| 6,924,776 | B2 * | 8/2005 | Le et al. | 343/792.5 |
| 7,053,852 | B2 * | 5/2006 | Timofeev et al. | 343/797 |
| 7,075,497 | B2 * | 7/2006 | Teillet et al. | 343/797 |
| 7,358,922 | B2 * | 4/2008 | Le et al. | 343/797 |

FOREIGN PATENT DOCUMENTS

KR 1020050005909 A 1/2005

* cited by examiner

*Primary Examiner*—Hoang V Nguyen
(74) *Attorney, Agent, or Firm*—Ladas & Parry LLP

(57) ABSTRACT

Provided are complex elements for an antenna of a radio frequency repeater and a dipole array circular polarization antenna using the same. The complex elements for the antenna of the RF repeater include: a plurality of radiation members which are separated from one another by a predetermined angular distance and has a radiation portion and a leg portion, the radiation portion comprising a pair of parallel portions, which are separated from each other in a vertical direction and are disposed to be parallel to each other, and a connection portion, which is disposed to be perpendicular to the pair of parallel portions and connects ends of each of the pair of parallel portions, and the leg portion extending from the radiation portion; and a plurality of feeding members, each of the feeding members connected to each of the radiation members that face each other, among the plurality of radiation members.

44 Claims, 18 Drawing Sheets

(UNIT: mm)

COMPLEX ELEMENTS FOR ANTENNA OF RADIO FREQUENCY REPEATER AND DIPOLE ARRAY CIRCULAR POLARIZATION ANTENNA USING THE SAME

CROSS-REFERENCE TO RELATED PATENT APPLICATION

This application claims the benefit of Korean Patent Application No. 10-2007-0086466, filed on Aug. 28, 2008, in the Korean Intellectual Property Office, the disclosure of which is incorporated herein in its entirety by reference.

BACKGROUND OF THE INVENTION

1. Field of the Invention

The present invention relates to complex elements for an antenna of a radio frequency (RF) repeater and a dipole array circular polarization antenna using the same, and more particularly, to complex elements for an antenna that is used in a radio frequency (RF) repeater system and that generates circular polarization, and a dipole array circular polarization antenna using the same.

2. Description of the Related Art

In a wireless network of a mobile communication system, due to nature and artificial obstacles such as mountains or buildings, tunnels, insides of buildings, etc., the intensity of propagation is reduced, and a shadow region in which reception of a radio frequency (RF) from a mobile terminal is not possible, is formed. A RF repeater re-amplifies base station signals to cover the shadow region that exists in a service area of a base station so that a good service can be provided to a user any time and any where. In the RF repeater, the shadow region can be removed by the simplest way.

In the RF repeater, a donor antenna for transmitting and receiving RF signals to and from the base station, and a service antenna for transmitting and receiving RF signals to and from a terminal are connected to each other. Downlink signals from the base station to the terminal are received by the donor antenna, are amplified by the RF repeater and then are transmitted to the terminal through the service antenna. Uplink signals from the terminal to the base station are received by the service antenna, are amplified by the RF repeater and then are transmitted to the base station through the donor antenna.

Generally, the donor antenna and the service antenna have directivity. Thus, it is idealistic that propagation is radiated only in a forward direction of an antenna. However, in the case of an actual antenna, propagation is not radiated only in the forward direction of the antenna but propagation is partially radiated even in a backward direction of the antenna. In this case, the ratio of intensity of propagation radiated in the forward direction to intensity of propagation radiated in the backward direction is a forward/backward ratio. As the forward/backward ratio increases, i.e., as the intensity of propagation radiated in the forward direction is large, an idealistic antenna is constituted.

In the case of the RF repeater, the donor antenna and the service antenna are in opposite directions. Since transmission and reception frequencies of each of the donor antenna and the service antenna are same, the frequency of a signal transmitted from the service antenna (or the donor antenna) and the frequency of a signal received from the donor antenna (or the service antenna) are same. Thus, in the case of the conventional RF repeater, a signal transmitted from an antenna is fed back to another antenna and is input. The RF repeater is oscillated and a normal operation cannot be performed. To prevent this problem, isolation (a degree at which a plurality of adjacent antennas are not interfered with each another) between two antennas needs to be improved by increasing the forward/backward ratio of the donor antenna and the service antenna.

FIG. 1 illustrates the structure of a conventional RF repeater.

Referring to FIG. 1, the conventional RF repeater comprises a donor antenna 110, a service antenna 120, and a repeater unit 130.

The donor antenna 110 receives an RF signal from a base station 140 or transmits the RF signal that is received from a wireless terminal 150 through the service antenna 120, to the base station 140. The service antenna 120 receives the RF signal from the wireless terminal 150 or transmits the RF signal that is received from the base station 140 through the donor antenna 110, to the wireless terminal 150. The repeater unit 130 filters and amplifies the RF signal between the donor antenna 110 and the service antenna 120.

In the RF repeater having the above structure, when separation between the donor antenna 110 and the service antenna 120 is not sufficiently gained, a signal that is re-transmitted through the service antenna 120 after the RF signal is amplified, is fed back to the donor antenna 110 so that the amplifier can be oscillated. Thus, a method of determining an amplification gain by which the separation between the donor antenna 110 and the service antenna 120 is gained to the maximum (generally, 60-70 dB) and a power amplifier is not oscillated, is used. In this case, since oscillation of the repeater is fatal to a network and a system, a gain of the amplifier is set to be 15-20 dB that is smaller than separation that is generally gained. Thus, the gain of the amplifier is about 40-55 dB, which limits a basic function of the repeater, i.e., a function of expanding a sufficient coverage or supplementing the shadow region and acts the greatest disadvantage of the RF repeater.

In addition, in the conventional RF repeater, since the donor antenna 110 and the service antenna 120 are disposed on same plane, directions of a main lobe and side lobes of each of the donor antenna 110 and the service antenna 120 are formed to the same height as an adjacent antenna in a horizontal direction. In this case, the main lobe and the side lobes that are directly reflected by ambient buildings or objects are vertically radiated in opposite direction to radiation direction, and interference occurs.

In order to prevent the interference due to the main lobe and the side lobes in the conventional RF repeater, an antenna for an RF repeater by using X-shaped dipole dual polarization radiation elements has been suggested. FIG. 2 illustrates a conventional plane-arranged circular polarization antenna for an RF repeater by using dipole dual polarization radiation elements.

Referring to FIG. 2, the conventional plane-arranged circular polarization antenna for the RF repeater by using the dipole dual polarization radiation elements comprises a plurality of radiation elements 210, a reflective patch element 220, an auxiliary reflective plate 230, and a feeding portion (not shown).

The plurality of radiation elements 210 are disposed on the reflective patch element 220 in a 4×4 arrangement and radiate incident propagation that is input through the feeding portion, in a form of right circular polarization or left circular polarization. Each of first through fourth radiation elements 310, 312, 314, and 316 is a 'ㄱ'-shaped conductor and constitutes the X-shaped radiation elements 210 by using first and second feeding members 320 and 330. In this case, the first feeding member 320 connects the first and third radiation elements 310 and 314, and the second feeding member 330 connects the second and fourth radiation members 312 and 316. In addition, electronic waves that are input to the first feeding member 320 and the second feeding member 330 are fed with a phase difference of 90°.

FIG. 3A illustrates the detailed structure of the radiation elements 210, and FIG. 3B illustrates the radiation shape of electronic waves radiated by the radiation elements 210.

Referring to FIGS. 3A and 3B, the radiation elements 210 comprise a plurality of radiation members 310, 312, 314, and 316, and a plurality of feeding members 320 and 330. In the radiation elements 210 having the above structure, when incident propagation having a phase difference of 90° is fed to each of the radiation members 310, 312, 314, and 316 through the feeding members 320 and 330, circular polarization that rotates once is radiated, as illustrated in FIG. 3B. FIG. 3C illustrates a horizontal radiation pattern at 2.17 GHz of the '¬'-shaped radiation elements 210. Referring to FIG. 3C, side lobes and rear lobes exist in the circular polarization that is generated by the corresponding radiation elements 210, and a forward/backward ratio of the circular polarization is equal to or less than 24 dB.

The reflective patch element 220 is in the form of a box having an opened upper portion. The radiation elements 210 are accommodated in the reflective patch element 220. In this case, due to the bottom surface and sidewalls of the reflective patch element 220, radiation propagation that is propagated in a backward direction is intercepted. In addition, the auxiliary reflective plate 230 is separated from the outside of the sidewalls of the reflective patch element 220 and additionally intercepts radiation propagation that is propagated in the backward direction. A feeding portion 240 feeds electronic waves so that a phase difference of 90° occurs sequentially in the radiation elements 210 each having a 2×2 arrangement that constitutes a 4×4 arrangement. Thus, radiation propagation is radiated by the elements 220 each having a 2×2 arrangement with a phase difference of 0°, 90°, 180°, and 270° in a sequence.

FIGS. 4A and 4B illustrate horizontal and vertical radiation patterns of the conventional plane-arranged circular polarization antenna for the repeater by using the dipole dual polarization radiation elements illustrated in FIG. 2. Referring to FIGS. 4A and 4B, the conventional plane-arranged circular polarization antenna for the RF repeater by using the dipole dual polarization radiation elements shows a side lobe level that is equal to or less than −25 dB in a horizontal radiation characteristic and shows a side lobe level that is equal to or less than −20 dB in a vertical radiation characteristic.

However, the conventional plane-arranged circular polarization antenna for the RF repeater by using the dipole dual polarization radiation elements described with reference to FIGS. 2 through 4B shows a good characteristic in the side lobe level. However, since a beam width is about 30°, a service area is reduced. In addition, in a feeding method, a plurality of phase delay elements need to be installed so as to feed electronic waves to each of the radiation elements so that a phase difference of 90° occurs, and an additional element for impedance matching is needed. As such, the size of the antenna increases and manufacturing costs thereof increase.

SUMMARY OF THE INVENTION

The present invention provides complex elements for an antenna of a radio frequency (RF) repeater in which interference due to a main lobe and side lobes can be minimized and in which a feeding method by which impedance matching and occurrence of circular polarization are simultaneously achieved with a relatively large beam width, is used, and a dipole array circular polarization antenna using the same.

According to an aspect of the present invention, there is provided complex elements for an antenna of a radio frequency (RF) repeater, the complex elements including: a plurality of radiation members which are separated from one another by a predetermined angular distance and comprises a radiation portion and a leg portion, the radiation portion comprising a pair of parallel portions, which are separated from each other in a vertical direction and are disposed to be parallel to each other, and a connection portion, which is disposed to be perpendicular to the pair of parallel portions and connects ends of each of the pair of parallel portions, and the leg portion extending from the radiation portion; and a plurality of feeding members, each of the feeding members connected to each of the radiation members that face each other, among the plurality of radiation members.

According to another aspect of the present invention, there is provided a dipole array circular polarization antenna in which a plurality of complex elements for an antenna of a radio frequency (RF) repeater are disposed on a bottom surface of a reflective patch element that absorbs and intercepts electronic waves and is formed in a form of a box shape having an opened upper portion, by a predetermined distance, wherein the complex elements include: a plurality of radiation members which are separated from one another by a predetermined angular distance and comprises a radiation portion and a leg portion, the radiation portion comprising a pair of parallel portions, which are separated from each other in a vertical direction and are disposed to be parallel to each other, and a connection portion, which is disposed to be perpendicular to the pair of parallel portions and connects ends of each of the pair of parallel portions, and the leg portion extending from the radiation portion; and a plurality of feeding members, each of the feeding members connected to each of the radiation members that face each other, among the plurality of radiation members.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described in detail by explaining exemplary embodiments of the invention with reference to the attached drawings.

Figure 1:
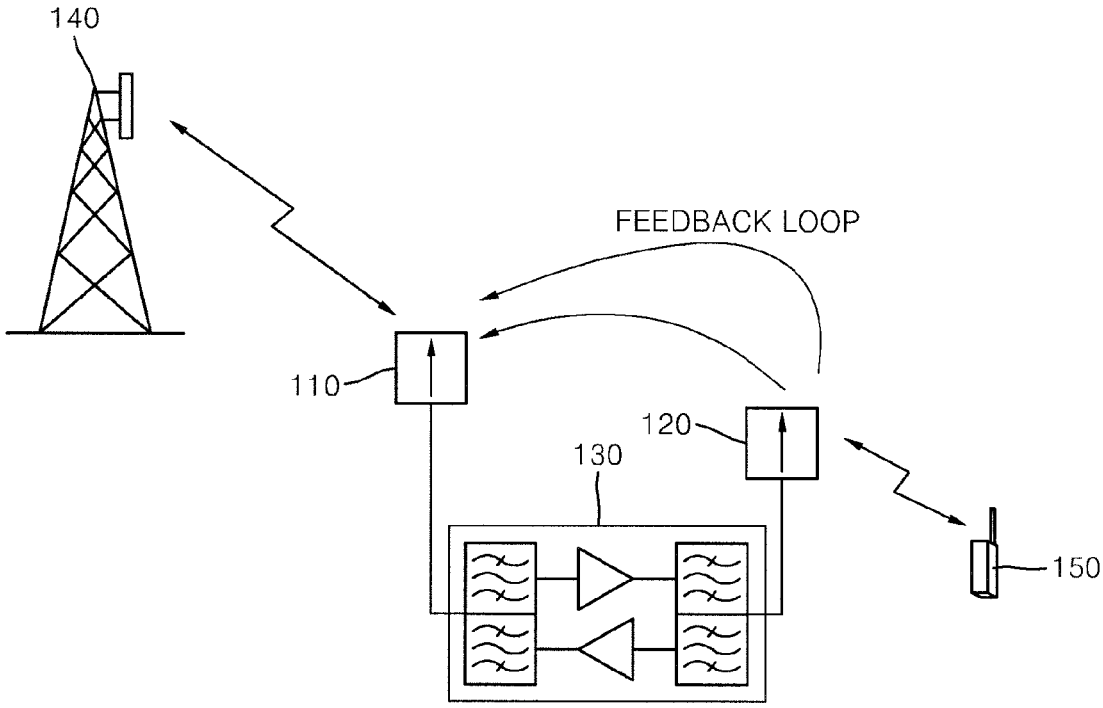
FIG. 1 Related Art
FIG. 1 illustrates the structure of a conventional radio frequency (RF) repeater.
Figure 2:
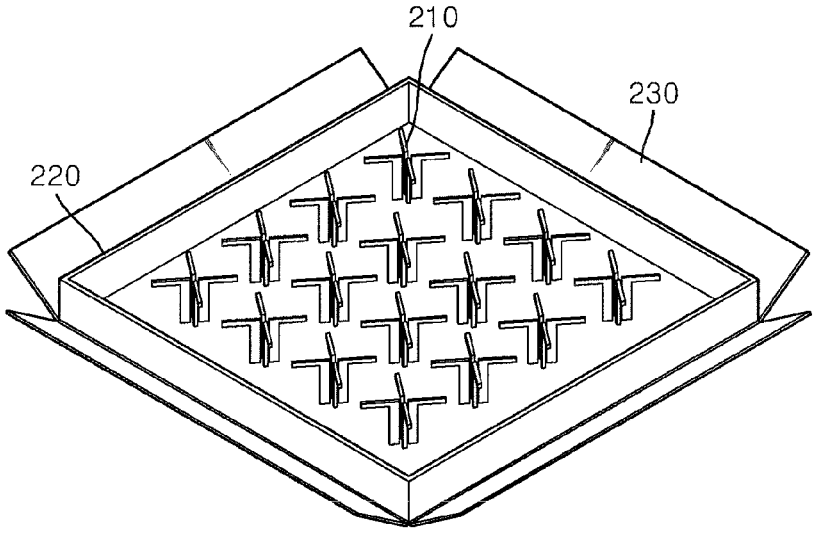
FIG. 2 Related Art
FIG. 2 illustrates a conventional plane-arranged circular polarization antenna for an RF repeater by using dipole dual polarization radiation elements.
Figure 3A:
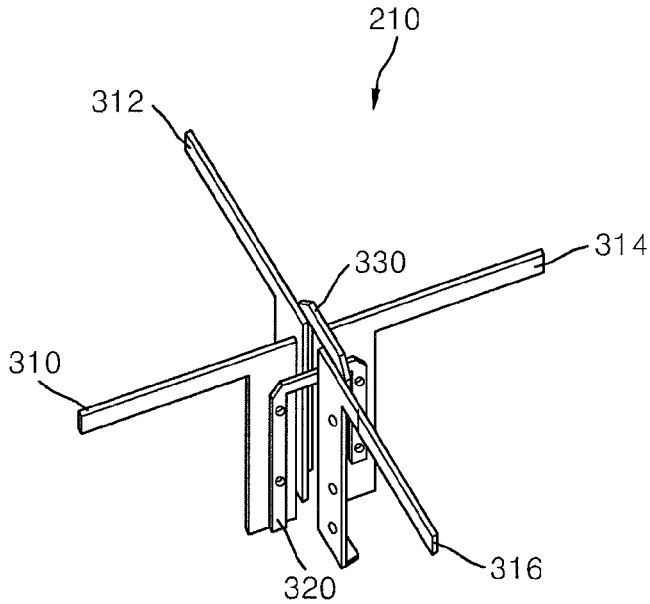
FIG. 3A Related Art
FIG. 3A illustrates the detailed structure of radiation elements of the conventional plane-arranged circular polarization antenna for an RF repeater by using dipole dual polarization radiation elements of FIG. 2.
Figure 3B:
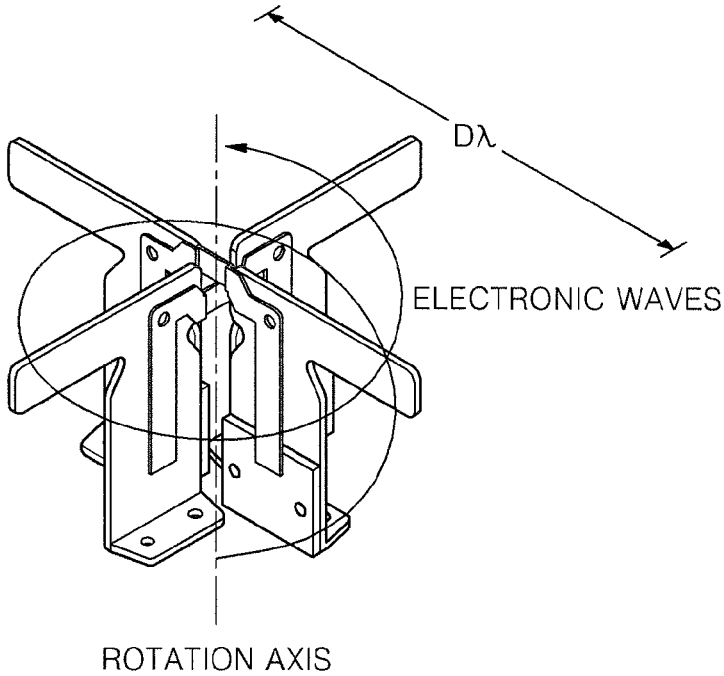
FIG. 3B Related Art
FIG. 3B illustrates the radiation shape of electronic waves radiated by the radiation elements of the conventional plane-arranged circular polarization antenna for an RF repeater by using dipole dual polarization radiation elements of FIG. 2.
Figure 3C:
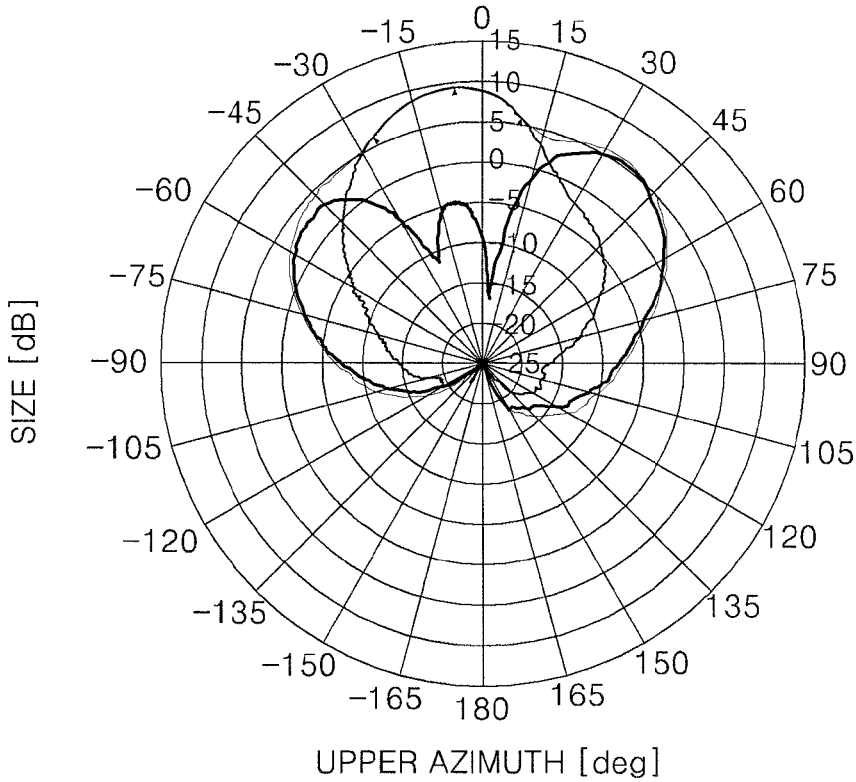
FIG. 3C Related Art
FIG. 3C illustrates a horizontal radiation pattern at 2.17 GHz of the radiation elements of the conventional plane-arranged circular polarization antenna for an RF repeater by using dipole dual polarization radiation elements of FIG. 2.
Figure 4A:
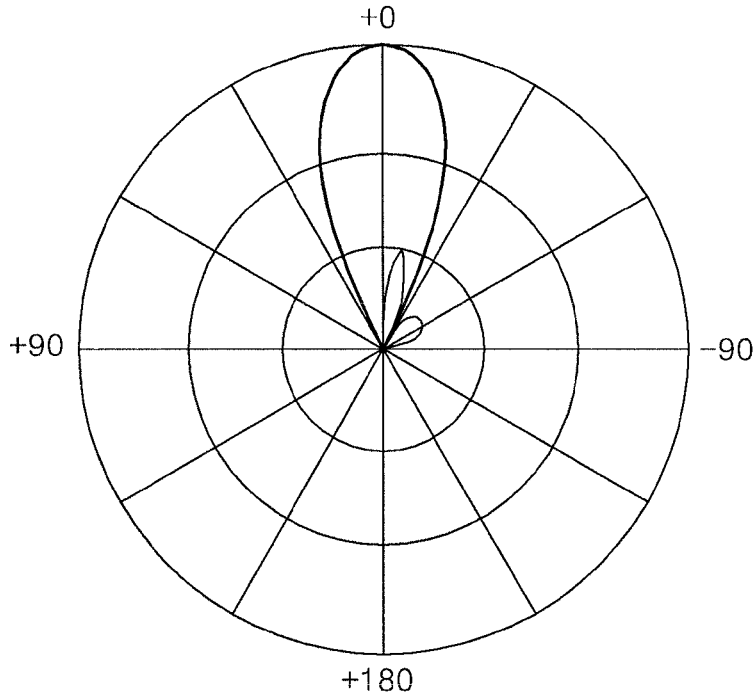
FIG. 4A Related Art
FIGS. 4A and 4B illustrate horizontal and vertical radiation patterns of the conventional plane-arranged circular polarization antenna for the repeater by using the dipole dual polarization radiation elements illustrated in FIG. 2.
Figure 4B:
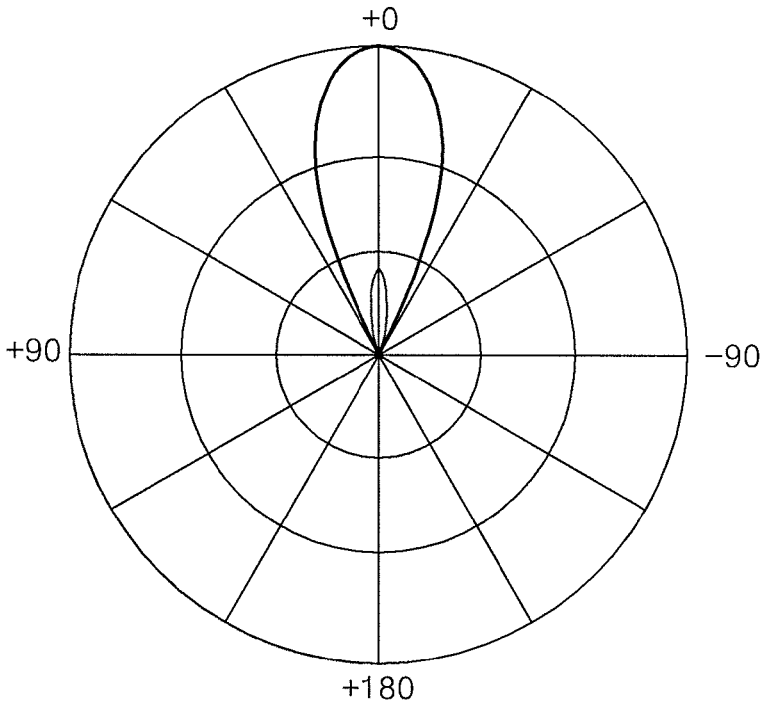
FIG. 4B Related Art
Figure 5:
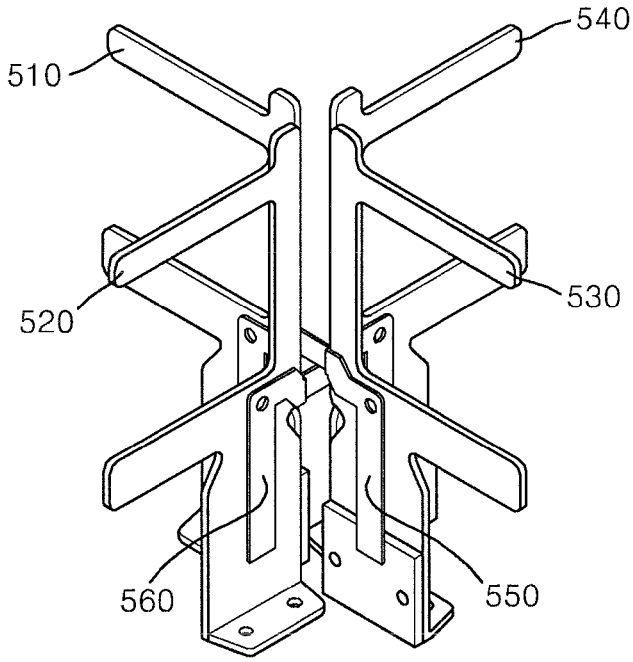
FIG. 5 illustrates the structure of complex elements for an antenna of a radio frequency (RF) repeater according to an embodiment of the present invention.
Figure 6A:
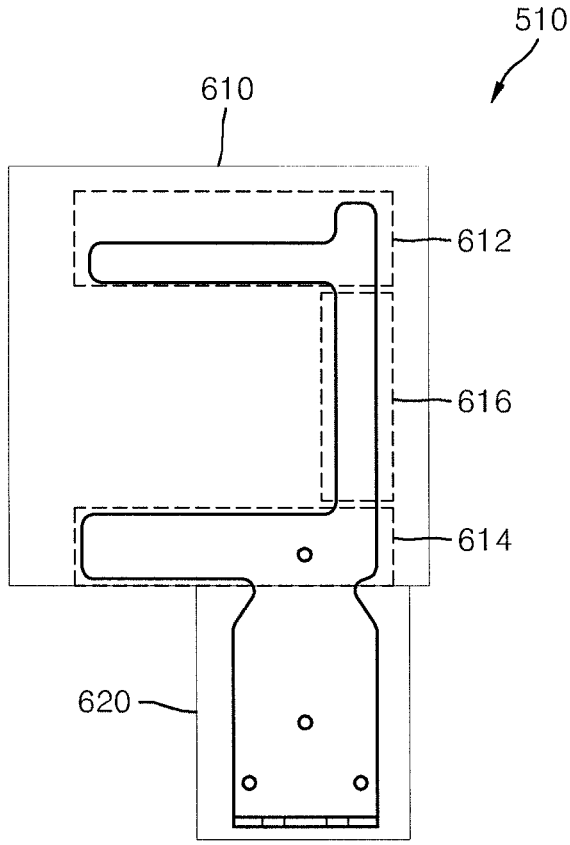
FIGS. 6A through 6C illustrate the detailed structure of components of the complex elements for the antenna of the RF repeater.
Figure 6B:
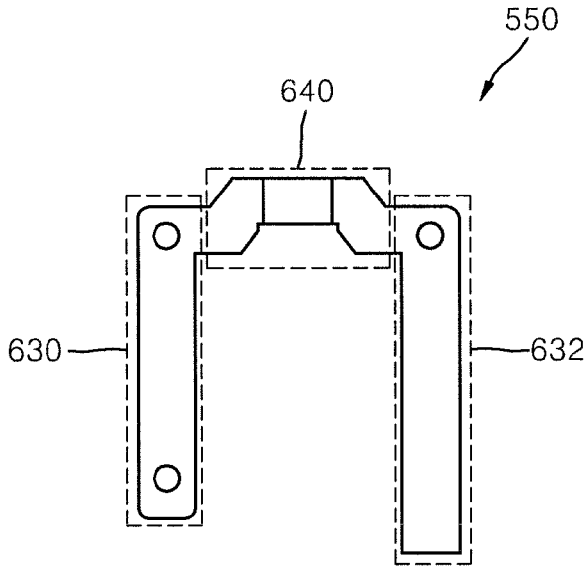
Figure 6C:
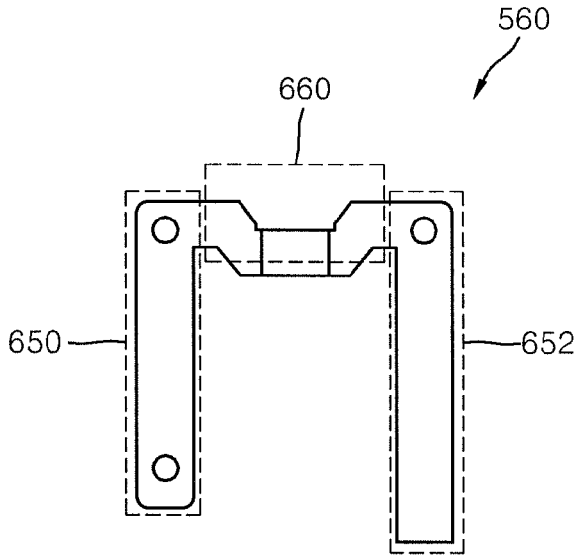

FIG. 5 illustrates the structure of complex elements 500 for an antenna of a radio frequency (RF) repeater according to an embodiment of the present invention, and FIGS. 6A through 6C illustrate the detailed structure of components of the complex elements for the antenna of the RF repeater.

Referring to FIGS. 5 through 6C, the complex elements 500 for the antenna of the RF repeater according to the current embodiment of the present invention comprises first through fourth radiation members 510, 520, 530, and 540 and first and second feeding members 550 and 560.

Each of the first through fourth radiation members 510, 520, 530, and 540 has same shape. As an example, the first radiation member 510 comprises a radiation portion 610 and a leg portion 620. The radiation portion 610 comprises a pair of parallel portions 612 and 614, which are separated from each other in a vertical direction and are disposed to be parallel to each other, and a connection portion 616, which is disposed to be perpendicular to the pair of parallel portions 612 and 614 and connects ends of each of the pair of parallel portions 612 and 614. In this case, the length of the first parallel portion 614 disposed in a lower position, of the pair of parallel portions 612 and 614 is smaller than ¼ of a wavelength λ of a start frequency (Fs), i.e., lower frequency, in a usable band, and the length of the second parallel portion 612 disposed in an upper position, of the pair of parallel portions 612 and 614 is smaller than ¼ of a wavelength λ of an end frequency (Fe), i.e., upper frequency, in the usable band. In this case, the pair of facing radiation members 510 and 530, 520 and 540 are separated from each other so that a distance between terminals of the parallel portions 612 and 614 disposed at bottom ends of each of the radiation members 510 and 530, 520 and 540 is ½ of the wavelength λ of the start frequency (Fs) in the usable band.

Meanwhile, one end of the second parallel portion 612 is protruded upwards. Thus, the length from a top end of the first parallel portion 614 to a terminal of a protrusion of the second parallel portion 612 is ¼ of the wavelength λ of the start frequency (Fs) in the usable band, and the length from the top end of the first parallel portion 614 to a top end of an end in which a protrusion of the second parallel portion 612 is not formed, is ⅛ to ¼ of the wavelength λ of the start frequency (Fs) in the usable band. In addition, the leg portion 620 extends from the radiation portion 610, and the length of the leg portion 620 is ¼ of the wavelength λ of the start frequency (Fs) in the usable band. Each of the radiation members 510, 520, 530, and 540 having the above shape are separated from one another at 90°. In addition, each of the radiation members 510, 520, 530, and 540 is formed of material such as aluminium (Al), white chromate, etc., which is the same material used for a rear choke formed as a plate body that absorbs or offsets electronic waves that flow through a bottom surface of a reflective patch element. When each of the radiation members 510, 520, 530, and 540 is formed of the same material as the material used for the rear choke, a potential difference between the radiation members 510, 520, 530, and 540 and the rear choke does not occur. Thus, durability is improved, and in particular, when the material is aluminium (Al), a light-weight antenna can be made.

The first and second feeding members 550 and 560 comprise first support portions 630 and 650, which are attached to each leg portion 620 of the radiation members 510 and 520 of the pair of radiation members 510 and 530, 520 and 540 that are connected to each other and which are attached to the parallel portion 614 disposed in a lower position, of the pair of parallel portions 612 and 614, second support portions 632 and 652, which are attached to the parallel portion 614 disposed in a lower position, of the pair of parallel portions 612 and 614 of the other radiation members 530 and 540 of the pair of radiation members 510 and 530, 520 and 540, and connection portions 640 and 660, which connect top ends of the first and second support portions 630 and 650 and 632 and 652 to one another. In this case, the length from terminals of the first support portions 630 and 650 to centers of the connection portions 640 and 650 is ¼ of the wavelength λ of the start frequency (Fs) in the usable band. In addition, the center of the first feeding member 550 of the first and second feeding members 550 and 560 is protruded upwards, and the center of the second feeding member 560 is protruded downwards so that each of the first and second feeding members 550 and 560 does not contact. The feeding members 550 and 560 are formed of metal containing copper (Cu), such as bronze, brass, etc.

The height and width of the complex elements for the antenna of the RF repeater comprising the first through fourth radiation members 510, 520, 530, and 540 and the first and second feeding members 550 and 560 having the above-mentioned shapes and sizes correspond to the length, which is ½ of the wavelength λ of the start frequency (Fs) in the usable band. The complex elements for the antenna of the RF repeater are used as basic elements, which are necessary to form circular polarization by using a dipole array circular polarization antenna that will be described later. In this case, an insulator formed of polytetrafluoroethylene (PTFE) is inserted between the feeding members 550 and 560 and the radiation members 510 and 530, 520 and 540 connected thereto, so that the feeding members 550 and 560 and the radiation members 510 and 530, 520 and 540 connected thereto are prevented from being short, and a bolt that fastens the feeding members 550 and 560 and the radiation members 510 and 530, 520 and 540 is formed of poly carbonate. Poly carbonate is a thermoplastic resin which is produced by a reaction between bisphenol A and phosgene ($COCl_2$), etc., has a high mechanical strength and excellent thermal resistance and electrical insulation.

In order to correctly operate the complex elements for the antenna of the RF repeater described with reference to FIGS. 5 through 6C, firstly, impedance matching with elements of the complex elements comprising the pair of radiation members 510 and 530, 520 and 540 and the feeding members 550 and 560 must be performed, and secondly, phase delay is needed to generate circular polarization.

Firstly, impedance matching with the elements of the complex elements will now be described. The simplest method is to connect the elements of the two complex elements in parallel. As an example, when the elements of the two complex elements having an impedance of 50Ω are connected in parallel, an impedance at a connection point is 25Ω. However, the case when impedance matching with devices connected to the elements of the complex elements such as a coaxial cable, an amplifier, etc. is not performed, is problematic. In this situation, a standing wave ratio (SWR) needs to be maintained at 1.5:1 and impedances at which the elements of the two complex elements are combined, need to be matched. This means that an impedance of 50Ω must be matched at a connection point of the elements of the two complex elements by using a coaxial cable having an impedance of 50Ω. Thus, the elements of each of the two complex elements must be matched with 50Ω. In this case, each of the elements of the two complex elements must have an impedance of 100Ω. As a result, an impedance of 50Ω must be matched at the connection point of the elements of the two complex elements. In the present invention, 50Ω impedance matching between the elements of the two complex elements and a generally-used coaxial cable is achieved by using a matching stub. In this case, impedance matching between a coaxial cable having a predetermined length and the elements of the two complex elements is performed by using an impedance converter such as 1×2, 1×4, 1×8 in-phase divider as a matching stub.

In order to match two different impedances, firstly, a middle impedance of a λ/4 (quarter wave) coaxial cable is calculated by using the following λ/4 (quarter wave equation 1.

$$Z=\sqrt{Z1\times Z2} \quad (1)$$

As an example, when an impedance must be matched with Z=50Ω, an impedance matching method when the elements of the two complex elements having a terminal point of an impedance of 40Ω are combined, is performed as below.

Figure 7A:
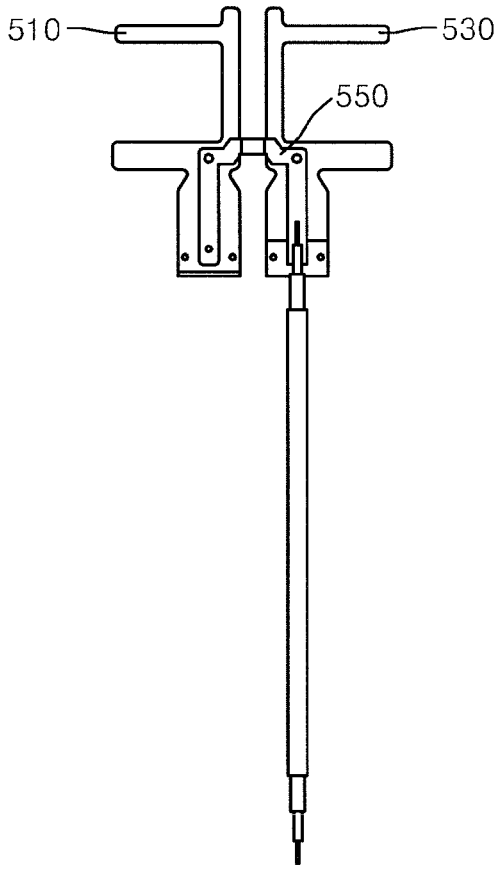
FIGS. 7A through 7C illustrates the complex elements for the antenna of the RF repeater that are manufactured by combining each element of the complement elements connected to a λ/4 (quarter wave) coaxial cable and elements of two complex elements.
Figure 7B:
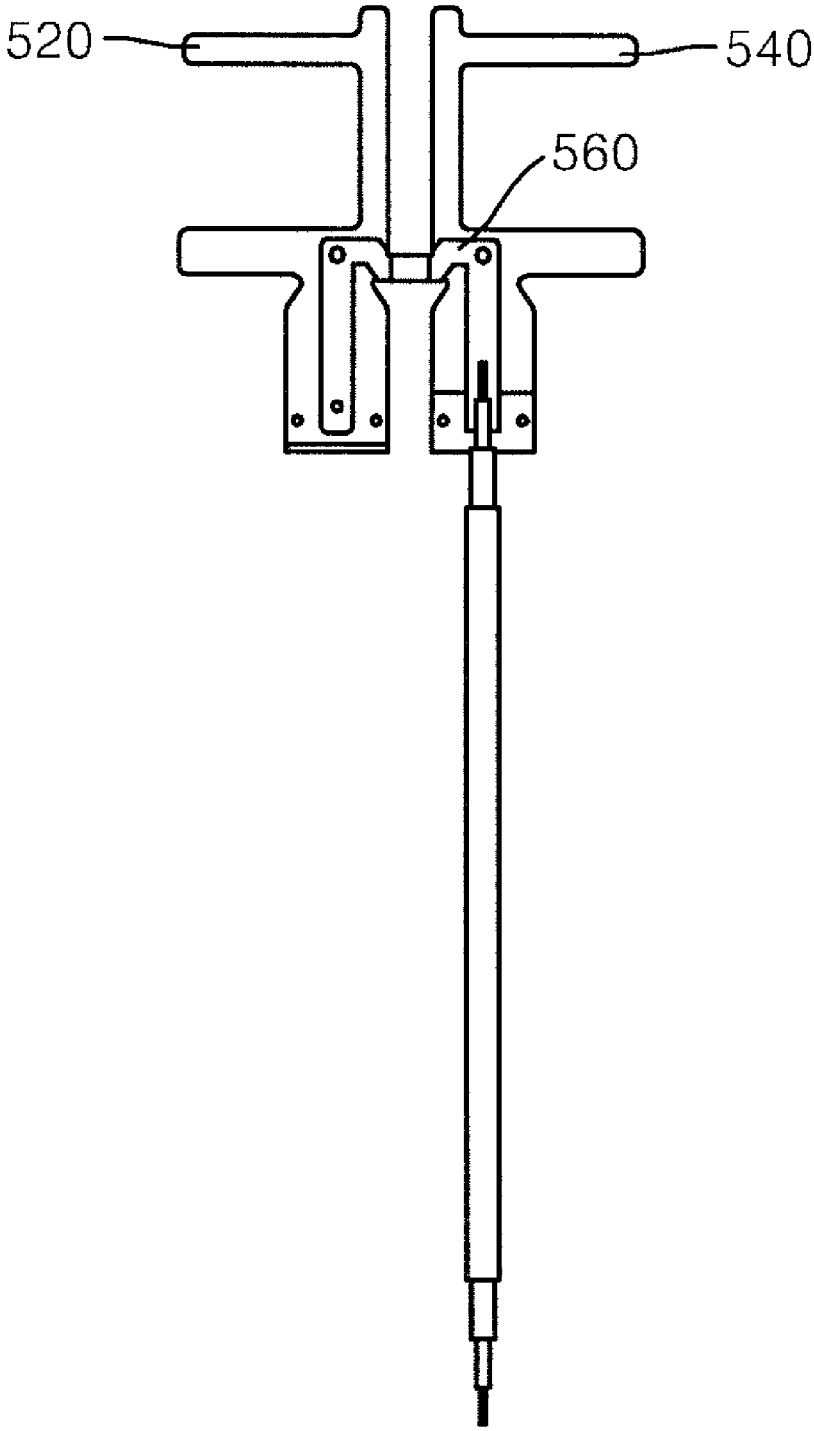
Figure 7C:
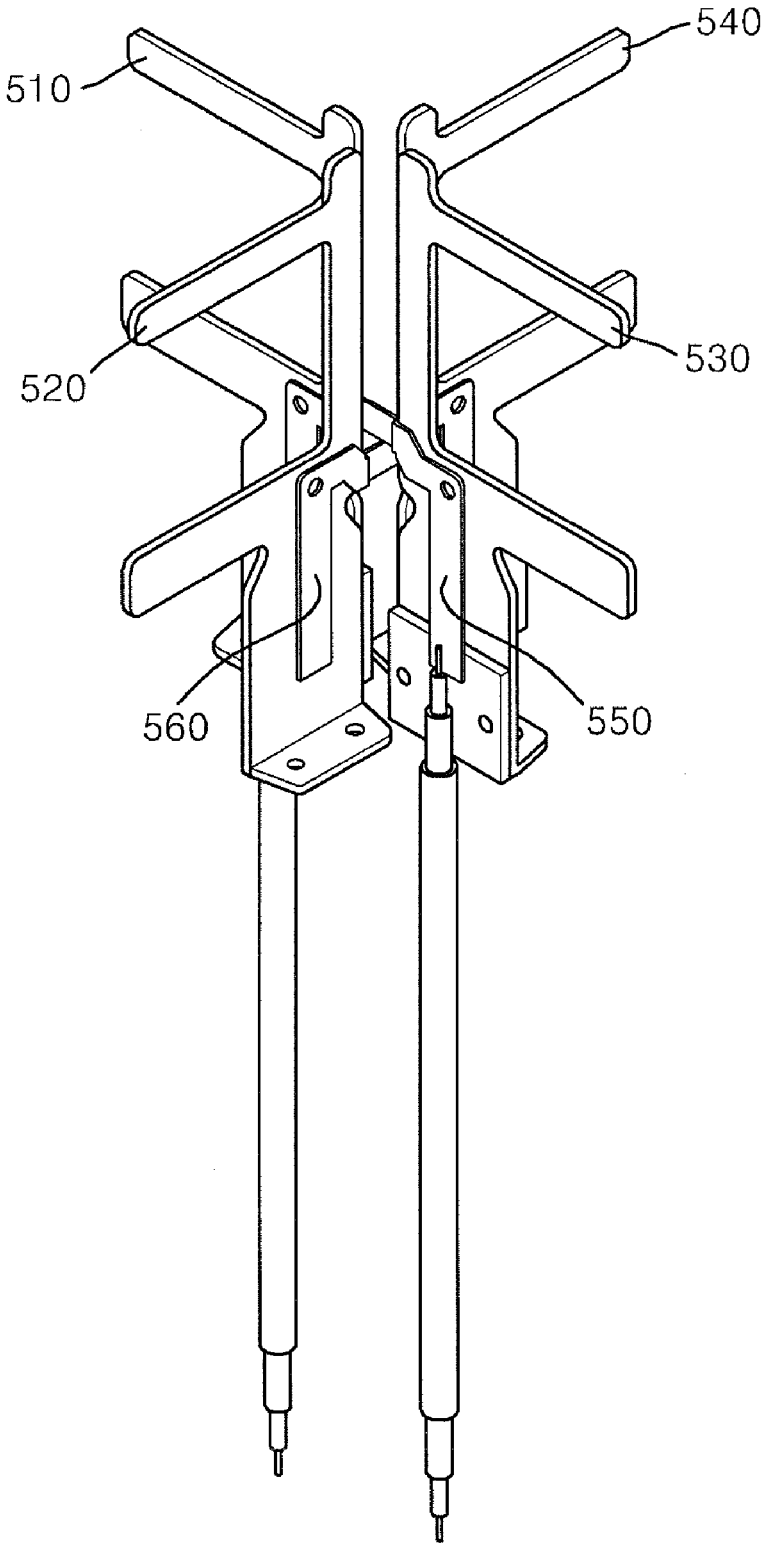

Firstly, in order to combine the two complex elements having a terminal point of an impedance of 40Ω by using the λ/4 (quarter wave) coaxial cable, a new impedance Z is calculated by using equation 1. Next, an impedance converter that is appropriate to the calculated impedance Z is designed to perform 50Ω impedance matching. In this case, when Z1 is an impedance of 50Ω of the elements of the complex elements and Z2 is a terminal point impedance of 40Ω, the new impedance Z calculated by using equation 1 is about 44.7Ω. Thus, an impedance of the elements of each of the complex elements connected to the λ/4 (quarter wave) coaxial cable is about 44.7Ω, as illustrated in FIGS. 7A and 7B. In order to match the elements of the two complex elements having an impedance of 44.7Ω with 50Ω, the elements of the two complex elements are combined with each other, as illustrated in FIG. 7C, thereby manufacturing the complex elements for the antenna of the RF repeater. When two λ/4 (quarter wave) coaxial cables are connected in parallel to the complex elements for the antenna of the RF repeater that is manufactured by combining the elements of the two complex elements having an impedance of 44.7Ω, the impedance is 22.4Ω. The impedance is connected to an in-phase divider or a quadrature hybrid combiner and divider and is finally matched with 50Ω.

Figure 8A:
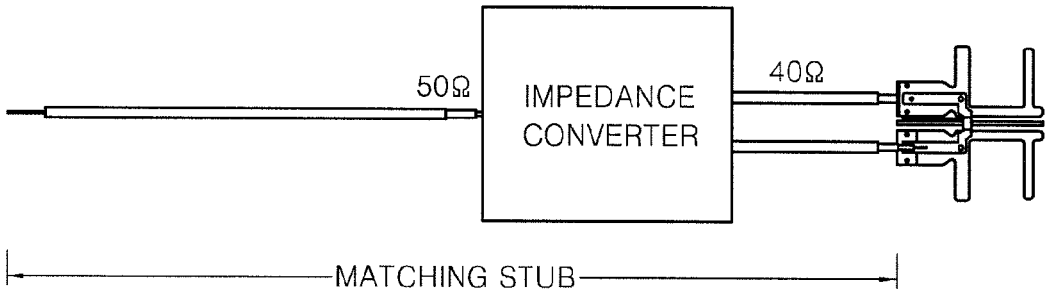
FIGS. 8A and 8B illustrate the states of impedance matching of a single antenna and multiple antennas by using a matching stub.
Figure 8B:
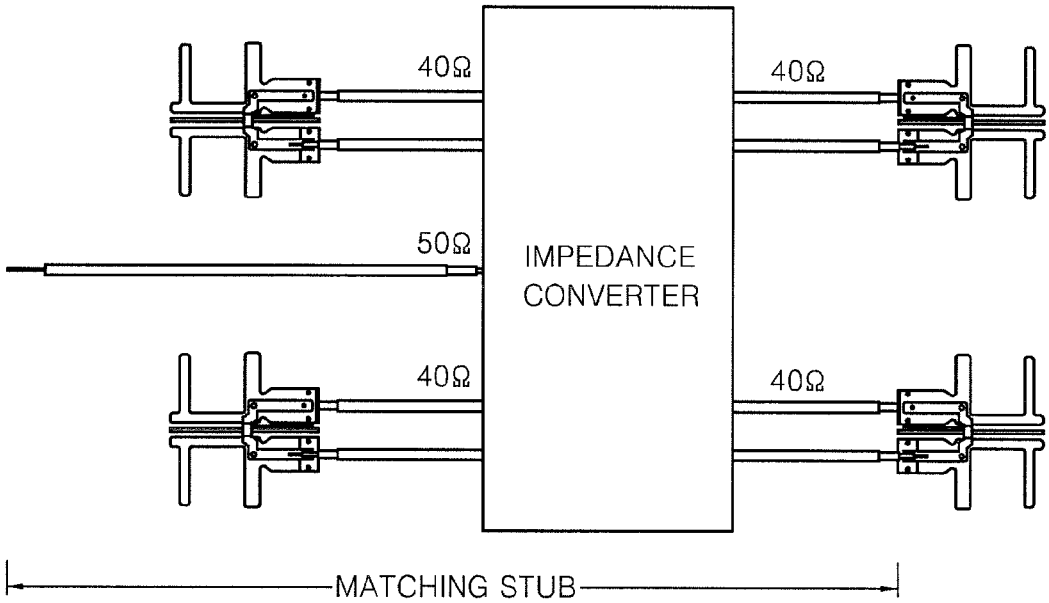

In order to constitute the entire matching stub for impedance matching of the complex elements for the antenna of the RF repeater that is manufactured by combining the elements of the two complex elements having an impedance of 44.7Ω, an impedance of a pattern connected to the impedance converter must be 27.6Ω. When a matching pattern is constituted in this manner, the matching pattern is combined with the complex elements for the antenna of the RF repeater having an impedance of 22.4Ω and is finally matched with a port having an impedance of 50Ω, and on the contrary, the matching pattern is separated from the port having an impedance of 50Ω and is matched with a port having an impedance of 22.4Ω. A portion that matches different impedances by using the impedance converter and the coaxial cable is referred to as a matching stub. As illustrated in FIGS. 8A and 8B, impedance matching of a single complex element or multiple complex elements is possible by using the matching stub.

In this case, the length of the coaxial cable connected to the feeding members of the complex elements for the antenna of the RF repeater is determined by performing the following operation.

Figure 9:
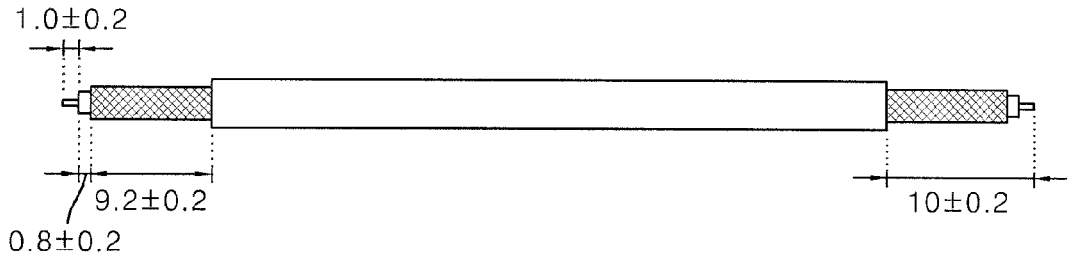
FIG. 9 illustrates the state of a coating operation of connecting the coaxial cable having a determined length to the complex elements for the antenna of the RF repeater.

First, the coaxial cable manufactured with 40Ω is selected. In this case, a difference between impedances of 40Ω and 50Ω is very small and thus, the coaxial cable having an impedance of 50Ω that can be easily obtained (50Ω Nominal SF-085 coaxial cable) may be selected. A velocity factor (VF) of the SF-085 coaxial cable is 0.66. This means that the propagation speed of electronic waves in the coaxial cable corresponds to 0.66 times the propagation speed of electronic waves in a free space. Next, a wavelength λ is calculated from an operating frequency. As an example, when the operating frequency is 2.0 GHz, which is a 3 G frequency band, a wavelength λ is 150 mm. Next, λ/4 is obtained, and in the case of 2.0 GHz frequency, λ/4 is 37.5 mm. Last, when λ/4 electric quarter wave (EQ) is electrically calculated, the length of the coaxial cable is 24.8 mm. In order to connect the coaxial cable having the determined length to a dipole antenna, a coating operation must be performed, as illustrated in FIG. 9. Referring to FIG. 9, the length of an exposed insulator is maintained at 0.8±0.2 mm, and the length of an exposed external conductor is maintained at 9.2±0.2 mm, and the length of an exposed internal conductor is maintained at 1.0±0.2 mm.

Figure 10A:
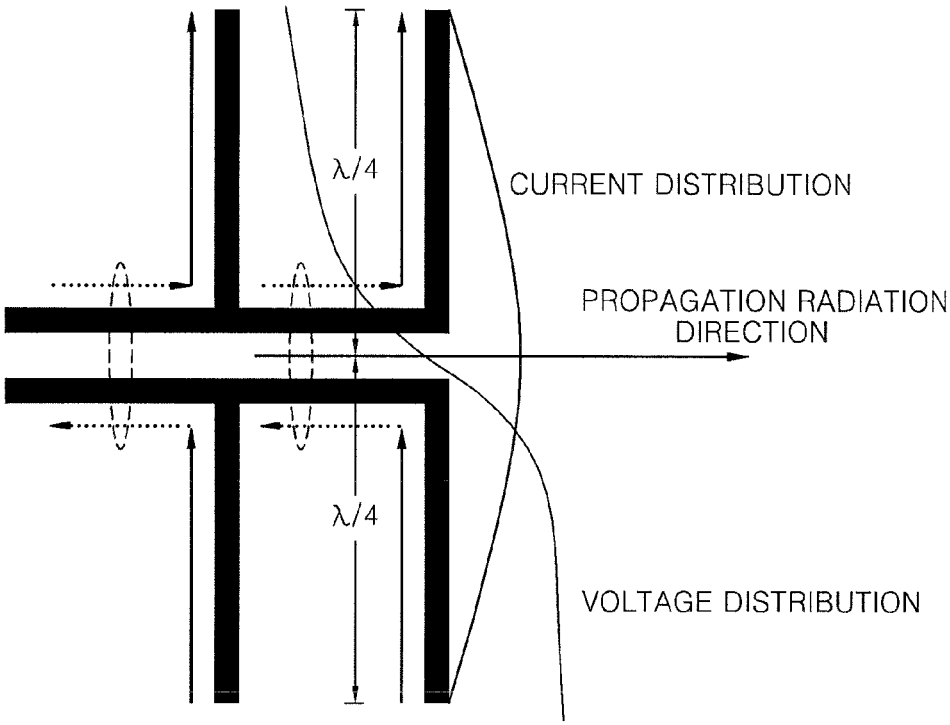
FIGS. 10A through 10C illustrate current distribution, radiation shape, and a horizontal radiation pattern of the complex elements for the antenna of the RF repeater illustrated in FIG. 5.
Figure 10B:
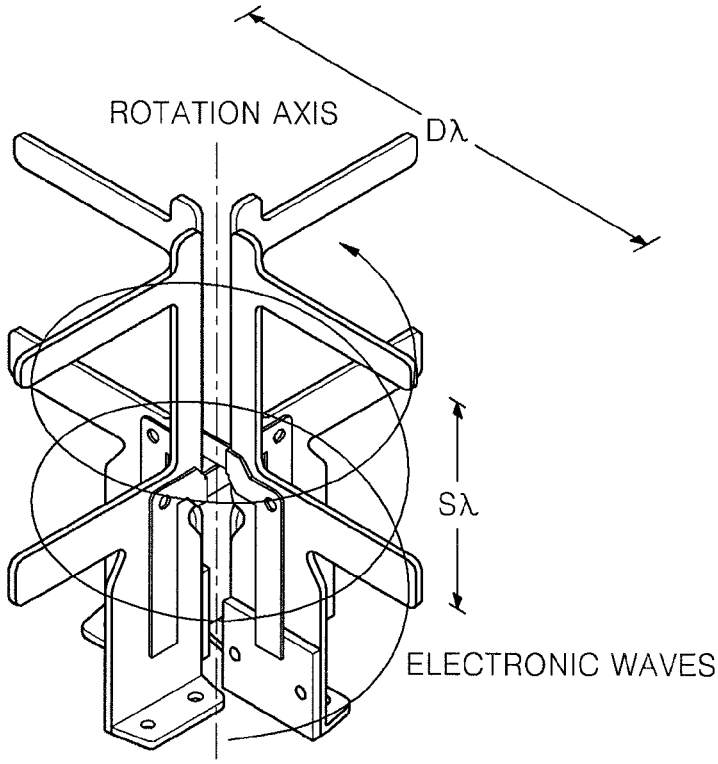
Figure 10C:
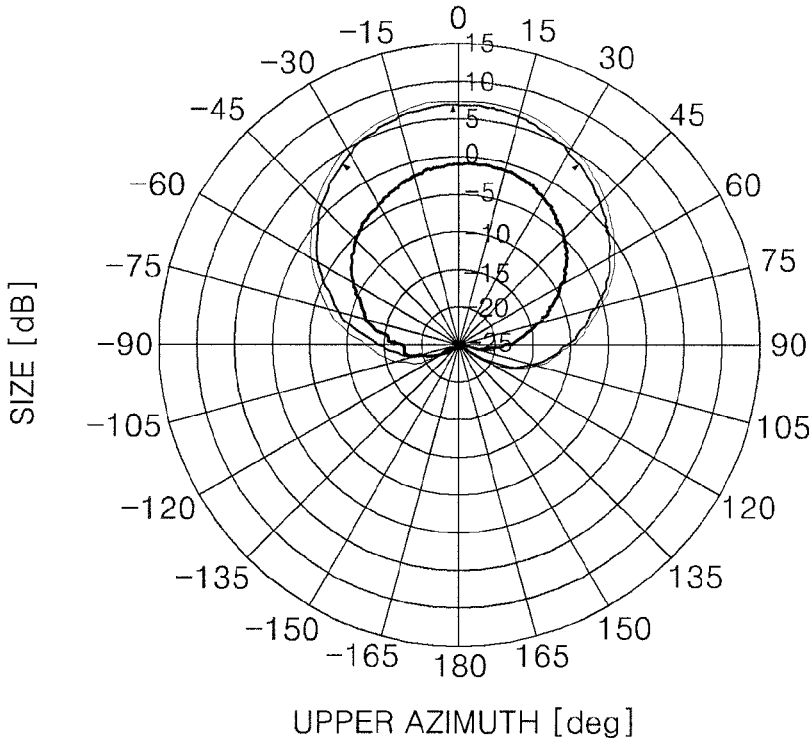

FIGS. 10A through 10C illustrate current distribution, radiation shape, and a horizontal radiation pattern of the complex elements for the antenna of the RF repeater illustrated in FIG. 5.

Referring to FIGS. 10A through 10C, directions of currents that flow through the facing radiation members 510 and 530, 520 and 540 are opposite, and current density is maximum in the center of the complex elements for the antenna of the RF repeater. In addition, a current flow is formed in each of parallel portions that are disposed perpendicular to the radiation direction of propagation. Due to the above structure, unlike conventional, 'ㄱ'-shaped radiation elements for radiating circular polarization that rotates once, the 'F'-shaped complex elements for the antenna of the RF repeater according to the present invention radiates circular polarization that rotates twice, as illustrated in FIG. 10B. Thus, the complex elements for the antenna of the RF repeater according to the present invention may obtain a high performance in view of a rotative force of circular polarization. In addition, as illustrated in FIG. 10C, the complex elements for the antenna of the RF repeater according to the present invention has an excellent performance compared to the conventional 'ㄱ'-shaped radiation elements in that the complex elements for the antenna of the RF repeater according to the present invention has a forward/backward ratio of about 32 dB and occurrence of a side lobe and a rear lobe is minimized. Characteristic variables of the complex elements for the antenna of the RF repeater according to the present invention are as below.

$$C\lambda=\pi D\lambda=0.75\lambda\sim1.33\lambda$$

$$S\lambda=0.2126\lambda\sim0.2867\lambda$$

$$AR=(2n+1)/2n$$

In this regard, Cλ is a circumferential length of circular polarization, and Dλ is a diameter of circular polarization, and Sλ is the axial length of one rotation, and AR is an axial ratio, and n is revolutions per minute (rpm) of circular polarization.

Hereinafter, a dipole array circular polarization antenna according to the present invention that is manufactured by disposing a plurality of complex elements for the antenna of the RF repeater described with reference to FIGS. 5 through 6C will be described.

Figure 11:
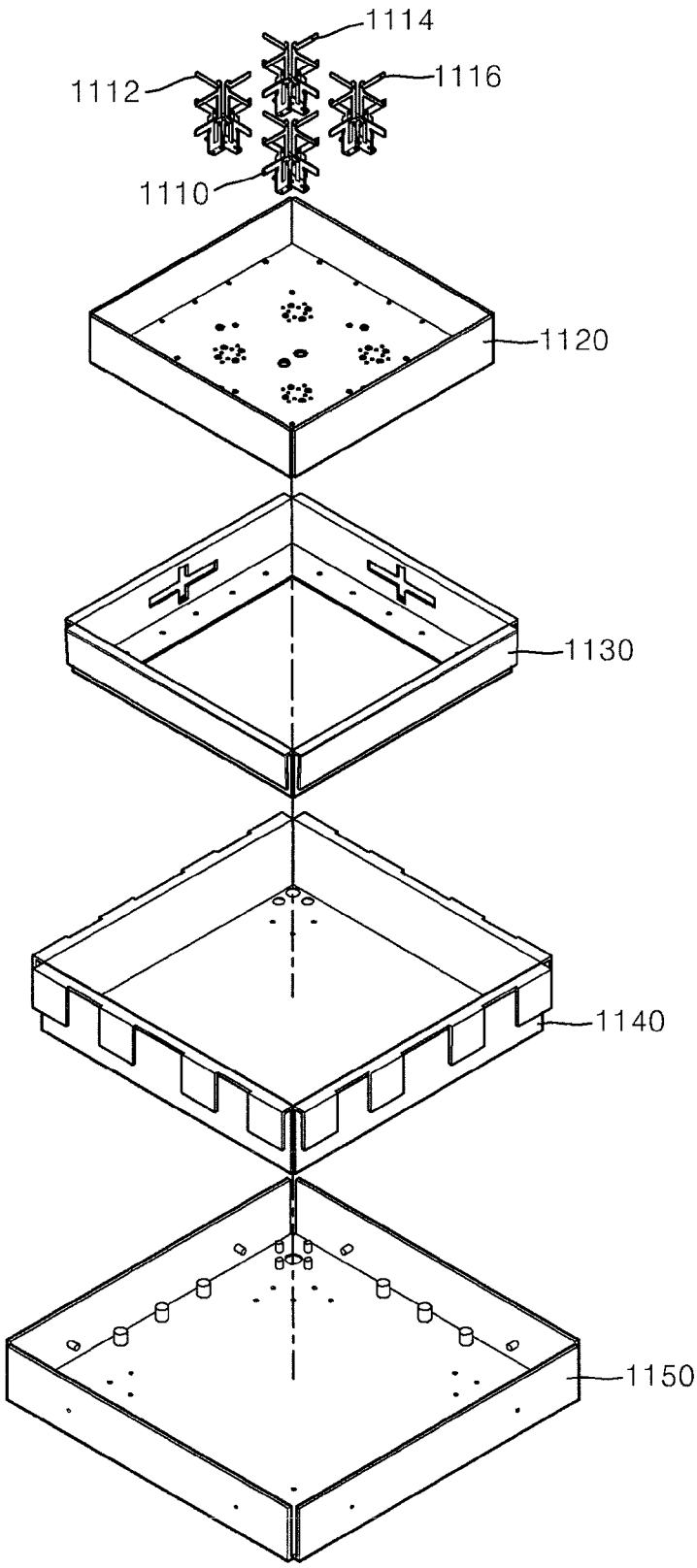
FIG. 11 is an exploded perspective view of a dipole array circular polarization antenna according to an embodiment of the present invention.

FIG. 11 is an exploded perspective view of a dipole array circular polarization antenna according to an embodiment of the present invention.

Referring to FIG. 11, the dipole array circular polarization antenna according to the current embodiment of the present invention comprises a plurality of complex elements 1110, 1112, 1114, and 1116, a first reflective patch element 1120, a first dummy patch element 1130, a second dummy patch element 1140, and a second reflective patch element 1150.

The plurality of complex elements 1110, 1112, 1114, and 1116 are separated from one another by a predetermined distance and are disposed on the first reflective patch element 1120. Each of the complex elements 1110, 1112, 1114, and 1116 is disposed in the form of a diamond with respect to the earth's surface. A distance between centers of the complex elements 1110, 1112, 1114, and 1116 is ½ of a wavelength λ of a start frequency (Fs) in a usable band. In addition, a distance from the center of each of the complex elements 1110, 1112, 1114, and 1116 to sidewalls that are closest to the first reflective patch element 1120, is ½ of the wavelength λ of the start frequency (Fs) in the usable band. Furthermore, a coaxial cable is connected to each of feeding members connecting the facing radiation members of a plurality of radiation members that constitute each of the complex elements 1110, 1112, 1114, and 1116.

The first reflective patch element 1120 is in the form of a box having an opened upper portion. The complex elements 1110, 1112, 1114, and 1116 are fixed on the bottom surface of the first reflective patch element 1120. A rear choke (not shown) that absorbs or offsets electronic waves radiated from the complex elements 1110, 1112, 1114, and 1116 in a backward direction, is installed on the top surface of the first reflective patch element 1120. The rear choke performs maximum radiation in a forward direction of the complex elements 1110, 1112, 1114, and 1116. Furthermore, a distance between the side surface of the first reflective patch element 1120 and centers of the complex elements 1110, 1112, 1114, and 1116 is adjusted to change a half power beam width (HPBW). The first reflective patch element 1120 has a square or rectangular shape according to a shape in which the complex elements 1110, 1112, 1114, and 1116 are disposed.

The first dummy patch element 1130 is in the form of a box having an opened upper portion, and the first reflective patch element 1120 is accommodated in the first dummy patch element 1130. At least one slit having a cross-shaped width and perforating inside and outside of the sidewalls, is formed in each of sidewalls of the first dummy patch element 1130. In this case, the width of the cross-shaped slit may be set to 1/16 of the wavelength λ of the start frequency (Fs) in the usable band (for example, when the wavelength λ of the start frequency (Fs) in the usable band is 1.9 GHz, the width of the cross-shaped slit is about 10 mm). In addition, in the cross-shaped slit, the length of a latitudinal slit is twice the length of a longitudinal slit, and the length of the longitudinal slit is ¼ of the wavelength λ of the start frequency (Fs) in the usable band. In addition, the first dummy patch element 1130 comprises a wing portion comprising a first wing portion that extends from the upper portion to the outside of each of the sidewalls and a second wing portion that extends to be bent and inclined (preferably, less than 5 degrees) toward the sidewalls from an end to a lower portion of the first wing portion. In this case, the length of the second wing portion is ¼ of the wavelength λ of the start frequency (Fs) in the usable band. The wing portion allows a radiation direction to be changed and to be toward the bottom surface of the first dummy patch element 1130 so that electronic waves passing the cross-shaped slit are reflected and are not flowed in the cross-shaped slit.

Meanwhile, when a plurality of cross-shaped slits are formed in same sidewalls of the first dummy patch element 1130, a portion of the wing portion (in particular, the second wing portion) is removed. The removal length thereof may be n (n is a positive integer) times ¼ of the wavelength λ of the start frequency (Fs) in the usable band. A portion of the wing portion of the first dummy patch element 1130 is removed in this way so that electronic waves can be prevented from being induced between two cross-shaped slits positioned in a portion in which the wing portion is removed. In view of a structure, edges of the wing portion of the first dummy patch element 1130 are opened, and electronic waves are induced and are returned to the first dummy patch element 1130. In this case, the most synthesis of electronic waves occurs in the center of the wing portion of the first dummy patch element 1130. Thus, a portion of the wing portion of the first dummy patch element 1130 is removed, and a portion in which electronic waves are synthesized is distributed so that a phenomenon that the electronic waves are induced between the two cross-shaped slits positioned in the portion in which the wing portion of the first dummy patch element 1130 is removed, can be minimized.

The second dummy patch element 1140 is in the form of a box having an opened upper portion, and the first dummy patch element 1130 is accommodated in the first dummy patch element 1140. The second dummy patch element 1140 comprises a wing portion comprising a first wing portion that extends from the upper portion to the outside of each of the sidewalls and a plurality of second wing portions that extend from an end to a lower portion of the first wing portion along a direction perpendicular to the first wing portion and are separated from each other by a predetermined distance along the lengthwise direction of the first wing portion. In this case, the length of one side of the second wing portion may be ¼ of the wavelength λ of the start frequency (Fs) in the usable band. A distance between the second wing portions is set to be ¼ of the wavelength λ of the start frequency (Fs) in the usable band until the number of second wing portions reaches a predetermined number from edges formed by adjacent sidewalls. The second wing portions formed on the second dummy patch element 1140 are ½ of the wavelength λ of the start frequency (Fs) in the usable band than the second reflective patch element 1150 in which a current transmission path is placed outside the second dummy patch element 1140. Thus, a phase difference between electronic waves formed in the second dummy patch element 1140 and the second reflective patch element 1150 is 1800 so that an offset effect can be obtained. As a result, the second dummy patch element 1140 having the above structure secondarily absorbs or offsets radiation waves or electronic waves that are transmitted from the first dummy patch element 1130. Meanwhile, a first corner choke (not shown) formed of white chromate and constituted of a mechanical structure of ¼ or ½ of the wavelength λ of the start frequency (Fs) in the usable band and absorbs or offsets the electronic waves flowed into the second dummy patch element 1140, is installed between the first dummy patch element 1130 and the second dummy patch element 1140. The first corner choke is installed at the ear portion of the bottom surface of the second dummy patch element 1140.

The second reflective patch element 1150 in the form of a box having an opened upper portion, and the second dummy patch element 1140 is accommodated in the first dummy patch element 1150. The second reflective patch element 1150 intercepts a side lobe or a rear lobe that is generated by the radiation element and radiates other induced electronic waves in a forward direction so that radiation of electronic waves in the forward direction together with the first reflective patch element 1130 is maximum. A second corner choke (not shown) formed of white chromate and constituted of a mechanical structure of ¼ or ½ of the wavelength λ of the start frequency (Fs) in the usable band and absorbs or offsets the electronic waves radiated in a backward direction, is installed between the second reflective patch element 1150 and the second dummy patch element 1140. The second corner choke is installed at the ear portion of the bottom surface of the second reflective patch element 1150.

In order to radiate circular polarization by using the dipole array circular polarization antenna described with reference to FIG. 11, phases of electronic waves that are fed to each of the complex elements 1110, 1112, 1114, and 1116 of the dipole array circular polarization antenna must be 0°, 90°, 180°, and 270°, respectively. In the present invention, this is achieved by adjusting the length of the coaxial cable connected to each of the complex elements 1110, 1112, 1114, and 1116. The length of the coaxial cable for generating circular polarization is determined by using equation 2:

$$L_{ij} = VF \times \frac{\lambda}{4}(n + i + j - 1), \quad n = 1,3,5,7\Lambda,\ i = 1,2,3,\Lambda,\ j = 1, 2, \tag{2}$$

where $L_{ij}$ is the length of the coaxial cable (where i is a sequence in which each of the complex elements is disposed in the form of a diamond clockwise or counterclockwise, and j is a sequence in which the coaxial cable is connected to each of the complex elements clockwise or counterclockwise), and VF is a velocity factor of the coaxial cable, and λ is a wavelength of radiation propagation.

When the dipole array circular polarization antenna is viewed from the rear side of the first reflective patch element 1120 and polarization that rotates clockwise is right polarization, and polarization that rotates counterclockwise is left polarization, the length of the coaxial cable that is calculated by using equation 2 when the wavelength of radiation propagation is 37.5 mm, is as below.

TABLE 1

| Types of Polarization | Coaxial Cable No. | Coaxial Cable Length (mm) |
|---|---|---|
| Right polarization | $L_{11}$ | 99 |
| | $L_{12}$ | 124 |
| | $L_{21}$ | 124 |
| | $L_{22}$ | 149 |
| | $L_{31}$ | 149 |
| | $L_{32}$ | 173 |
| | $L_{41}$ | 173 |
| | $L_{42}$ | 198 |
| Left polarization | $L_{12}$ | 99 |
| | $L_{11}$ | 124 |
| | $L_{42}$ | 124 |
| | $L_{41}$ | 149 |
| | $L_{32}$ | 149 |
| | $L_{31}$ | 173 |
| | $L_{22}$ | 173 |
| | $L_{21}$ | 198 |

In Table 1, front subscripts of coaxial cable numbers are allocated to right and left polarization sequentially clockwise from the complex element 1110 that is positioned in the lowest position, and rear subscripts of coaxial cable numbers are allocated to right and left polarization sequentially clockwise from coaxial cables connected to one complex element. In addition, n that is set to the first cable connected to the complex element 1110 positioned in the lowest position is 3. In addition, each of the coaxial cables is connected to a ¼ wavelength hybrid impedance converter to which a coaxial cable for matching having an impedance of 50Ω is connected. Each of the coaxial cables constitutes a matching stub for impedance matching. The matching stub is illustrated in FIG. 8B.

Two of 8 coaxial cables having the lengths shown in Table 1 are combined with one complex element. A difference in the lengths of the coaxial cables having a λ/4 length is set so that electronic waves fed to the complex elements cause a phase difference at 90°. Thus, when it is assumed that, when right polarization is formed, the complex element 1110 positioned in the lowest position has a phase difference of 0° to 90°, the complex elements 1112, 1114, and 1116 disposed clockwise from the complex element 110 have phase differences of 90° and 180°, 180° and 270°, and 270° and 360° so that radiation waves are rotated.

Meanwhile, the dipole array circular polarization antenna according to the present invention may have various shapes according to the arrangement shape and number of complex elements.

Figure 12A:
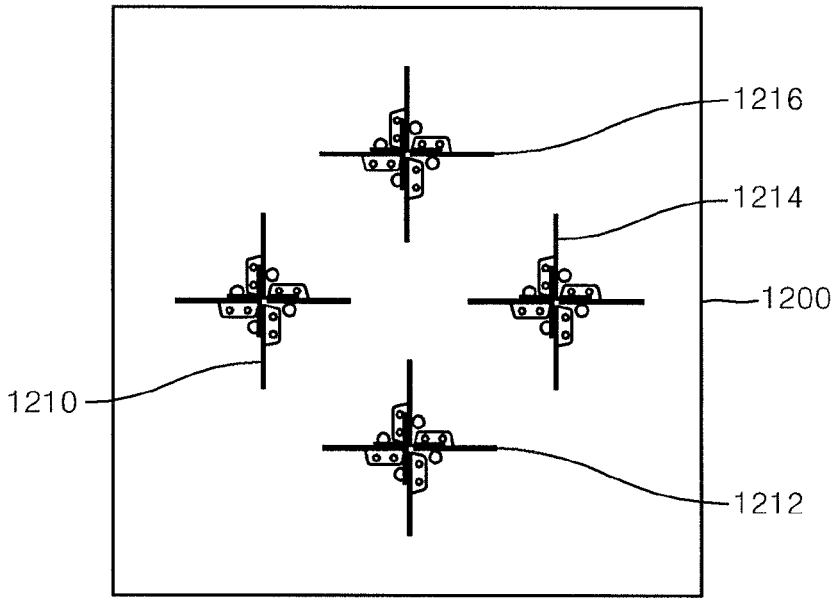
FIGS. 12A and 12B illustrate the dipole array circular polarization antenna having the most basic arrangement shape formed by four complex elements.
Figure 12B:
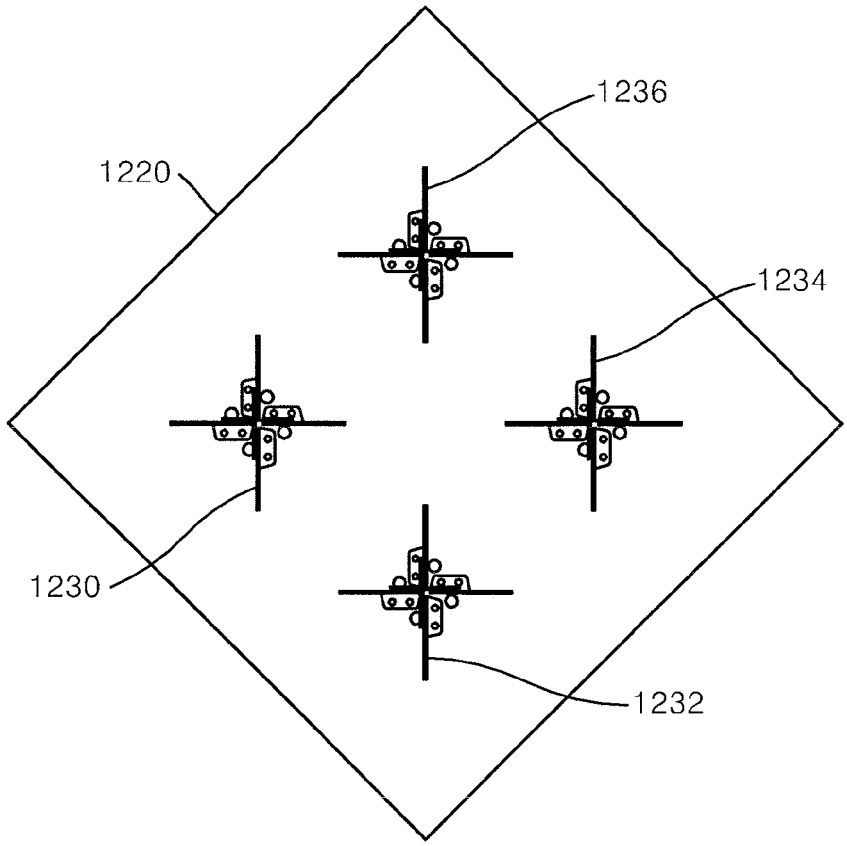

FIGS. 12A and 12B illustrate the dipole array circular polarization antenna having the most basic arrangement shape formed by four complex elements. In this case, elements of each of the four complex elements cross vertically and horizontally with respect to the earth's surface so that a horizontal radiation characteristic is formed at a desired angle. In the dipole array circular polarization antenna illustrated in FIG. 12A, four complex elements 1210, 1212, 1214, and 1216 are disposed on a straight line connecting centers of sides of a first reflective patch element 1200, and when the centers of the four complex elements 1210, 1212, 1214, and 1216 are connected, a diamond shape is formed. In this case, a distance between the center of each of the complex elements 1210, 1212, 1214, and 1216 is ½ of the wavelength λ of the start frequency (Fs) in the usable band, and a distance from the center of each of the complex elements 1210, 1212, 1214, and 1216 to sidewalls that are closest to the first reflective patch element 1200 is ½ of the wavelength λ of the start frequency (Fs) in the usable band. In the case of the arrangement shape of FIG. 12A, coaxial cables having lengths shown in Table 1 are connected to elements of each of the complex elements 1210, 1212, 1214, and 1216 according to rotation direction of circular polarization.

In addition, in the dipole array circular polarization antenna illustrated in FIG. 12B, four complex elements 1230, 1232, 1234, and 1236 are disposed on an orthogonal line of a first reflective patch element 1220, and when the centers of the four complex elements 1230, 1232, 1234, and 1236 are connected, a diamond shape is formed. In this case, a distance between the centers of the complex elements 1230, 1232, 1234, and 1236 is ½ of the wavelength λ of the start frequency (Fs) in the usable band, and a distance from the center of each of the complex elements 1230, 1232, 1234, and 1236 to sidewalls that are closest to the first reflective patch element 1220 is ½ of the wavelength λ of the start frequency (Fs) in the usable band. As illustrated in FIGS. 12A and 12B, when the distance between the centers of the four complex elements is set to be ½ of the wavelength λ of the start frequency (Fs) in the usable band, a circular pattern characteristic is best. In the case of the arrangement shape of FIG. 12A, coaxial cables having lengths shown in Table 1 are connected to elements of each of the complex elements 1230, 1232, 1234, and 1236 according to rotation direction of circular polarization.

As illustrated in FIGS. 12A and 12B, when the four complex elements are disposed in the most basic arrangement that constitutes the dipole array circular polarization antenna, there are two methods of designing a half power beam width (HPBW). One is a method of arranging complex elements so that a distance from centers of the complex elements to sidewalls that are closest to the first reflective patch element 1200 is ½ of the wavelength λ of the start frequency (Fs) in the usable band, and a HPBW of a horizontal radiation pattern is 45°, and a HPBW of a vertical radiation pattern is 22° in a frequency band of 1.9 GHz. The other one is a method of arranging complex elements so that a distance from sidewalls that are closest to the first reflective patch element 1200 to centers of the complex elements is ¼ of the wavelength λ of the start frequency (Fs) in the usable band, and a beam width is extended to about 10° to 15° and a HPBW of a horizontal radiation pattern is 45°, and a HPBW of a vertical radiation pattern is about 22° to 33° in a frequency band of 1.9 GHz. This is the same as the case when the complex elements are arranged so that a diagonal distance from the centers of the complex elements to sidewalls that are closest to the first reflective patch element 1200 is ¼ of the wavelength λ of the start frequency (Fs) in the usable band.

Figure 14A:
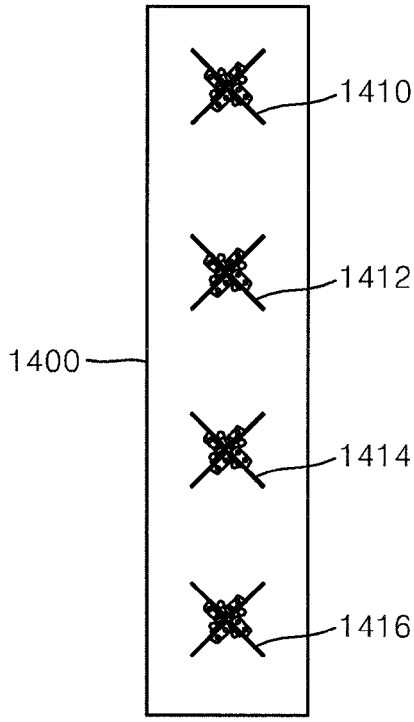
FIGS. 14A and 14B illustrate shapes in which four complex elements are arranged vertically.
Figure 14B:
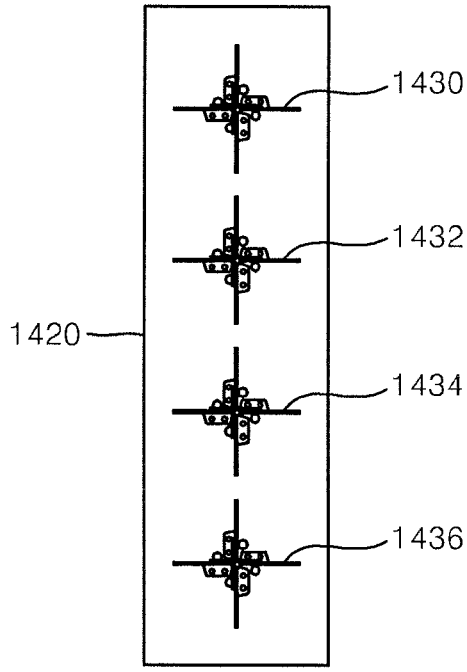

FIGS. 14A and 14B illustrate shapes in which four complex elements are arranged vertically. When the dipole array circular polarization antenna is constituted as illustrated in FIGS. 14A and 14B, a gain is not large but a horizontal radiation characteristic of a HPBW is improved. In the dipole array circular polarization antenna illustrated in FIG. 14A, a first reflective patch element 140 has a rectangular shape, and a distance between centers of complex elements 1410, 1412, 1414, and 1416 is ¼ or ½ (preferably, ½) of the wavelength λ of the start frequency (Fs) in the usable band. In addition, a distance from the center of each of the complex elements 1410, 1412, 1414, and 1416 to sidewalls that are closet to the first reflective patch element 1400 is ¼ or ½ (preferably, ½) of the wavelength λ of the start frequency (Fs) in the usable band. In this case, a line extending elements of each of the complex elements 1410, 1412, 1414, and 1416 has an angle of 45° or 135° with respect to the side surface of the first reflective patch element 1400.

In addition, in a feeding method, elements are fed to each of the two complex elements 1410 and 1412 positioned in the upper position, with phases of 0° and 90°, and elements are fed to each of the two complex elements 1414 and 1416 positioned in the lower position, with phases of 180° and 270°. Thus, lengths of first coaxial cables connected to elements fed with a phase of 0° of each of the two complex elements 1410 and 1412 positioned in the upper position (i.e., coaxial cables connected to a radiation member positioned in an upper left position of each of the complement elements) are same. In addition, lengths of second coaxial cables connected to elements fed with a phase of 90° of each of the two complex elements 1410 and 1412 positioned in the upper position (i.e., coaxial cables connected to a radiation member positioned in an upper right position of each of the complement elements) are same. The lengths of second coaxial cables must be ¼ of the wavelength λ of the start frequency (Fs) in the usable band, which is larger than the lengths of the first coaxial cables so that a phase difference of 90° occurs. The relation of the lengths of the coaxial cables and connection thereof apply to the two complex elements 1414 and 1416 positioned in the lower position. The lengths of coaxial cables connected to a radiation member positioned in a lower right position of each of the complex elements 1414 and 1416 must be ¾ of the wavelength λ of the start frequency (Fs) in the usable band, which is larger than the lengths of the first coaxial cables, and the lengths of coaxial cables connected to a radiation member positioned in a lower left position of each of the complex elements 1414 and 1416 must be ¾ of the wavelength λ of the start frequency (Fs) in the usable band, which is larger than the lengths of the first coaxial cables.

Figure 15:
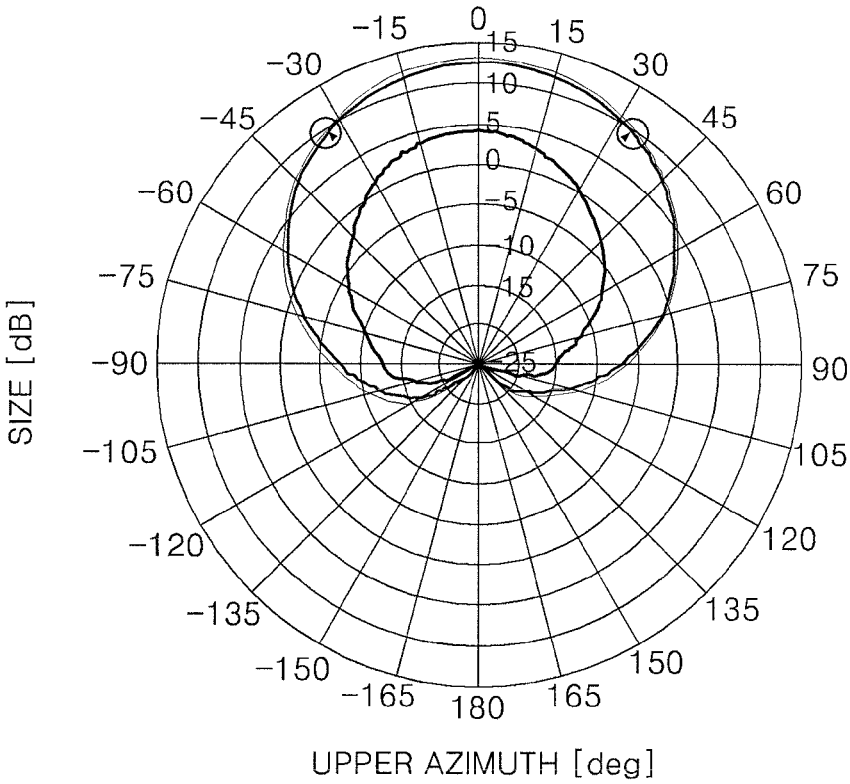
FIG. 15 illustrates a horizontal radiation pattern having the arrangement shape of FIG. 14A.

In the dipole array circular polarization antenna illustrated in FIG. 14A, a HPBW of a horizontal radiation pattern is 70°, and a HPBW of a vertical radiation pattern is 35° in a frequency band of 2.2 GHz. FIG. 15 illustrates a horizontal radiation pattern having the arrangement shape of FIG. 14A.

In addition, the only difference between the dipole array circular polarization antenna illustrated in FIG. 14A and the dipole array circular polarization antenna illustrated in FIG. 14B is that a line extending elements of each of complex elements 1430, 1432, 1434, and 1436 has an angle of 90° or 180° with respect to the side surface of the first reflective patch element 1420, and other configuration thereof is same. In this case, a beam width is extended to about 10°, and a HPBW of the horizontal radiation pattern is 80°, and a HPBW of the vertical radiation pattern is about 40° in a frequency band of 2.2 GHz. This is the same as the case when the complex elements are arranged so that a diagonal distance from the centers of the complex elements to sidewalls that are closest to the first reflective patch element 1420 is ¼ of the wavelength λ of the start frequency (Fs) in the usable band.

In the case of a feeding method of the dipole array circular polarization antenna illustrated in FIGS. 14A and 14B, elements are fed to each of the four complex elements 1430, 1432, 1434, and 1436 with phases of 0° and 90°, and elements are fed to each of the two complex elements 1414 and 1416 positioned in the lower position, with phases of 180° and 270°. Thus, lengths of first coaxial cables connected to elements fed with a phase of 0° of each of the four complex elements 1430, 1432, 1434, and 1436 (i.e., coaxial cables connected to a radiation member positioned in an upper position of each of the complement elements) are same. In addition, lengths of second coaxial cables connected to elements fed with a phase of 90° of each of the four complex elements 1430, 1432, 1434, and 1436 (i.e., coaxial cables connected to a radiation member positioned in the right of each of the complement elements) are same. The lengths of second coaxial cables must be ¼ of the wavelength λ of the start frequency (Fs) in the usable band, which is larger than the lengths of the first coaxial cables so that a phase difference of 90° occurs.

Figure 13:
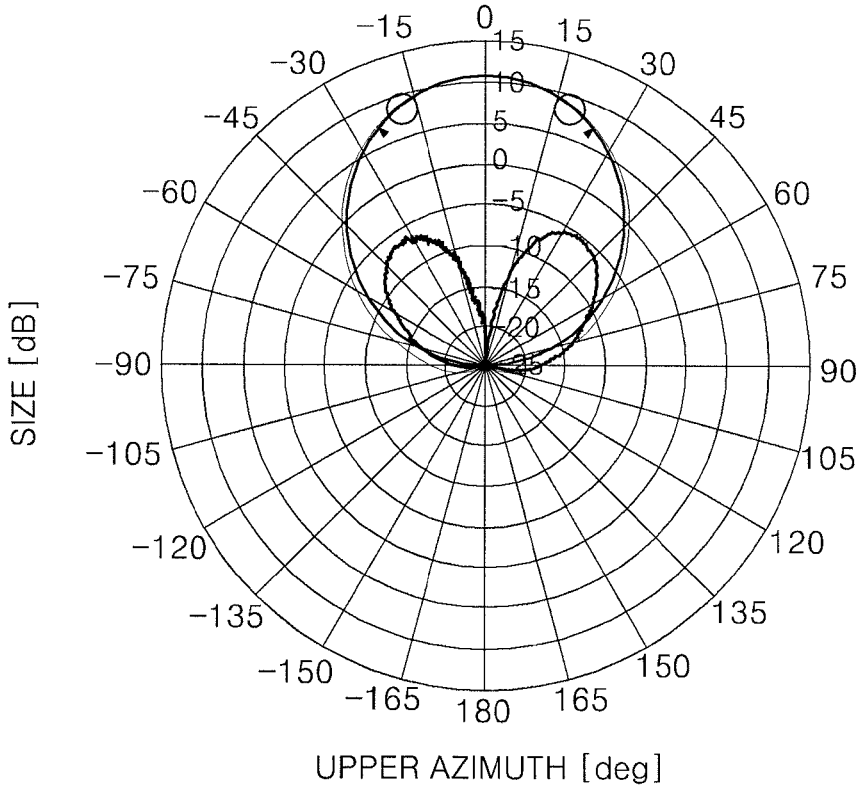
FIG. 13 illustrates a horizontal radiation pattern having the arrangement shape of FIG. 12A.
Figure 16:
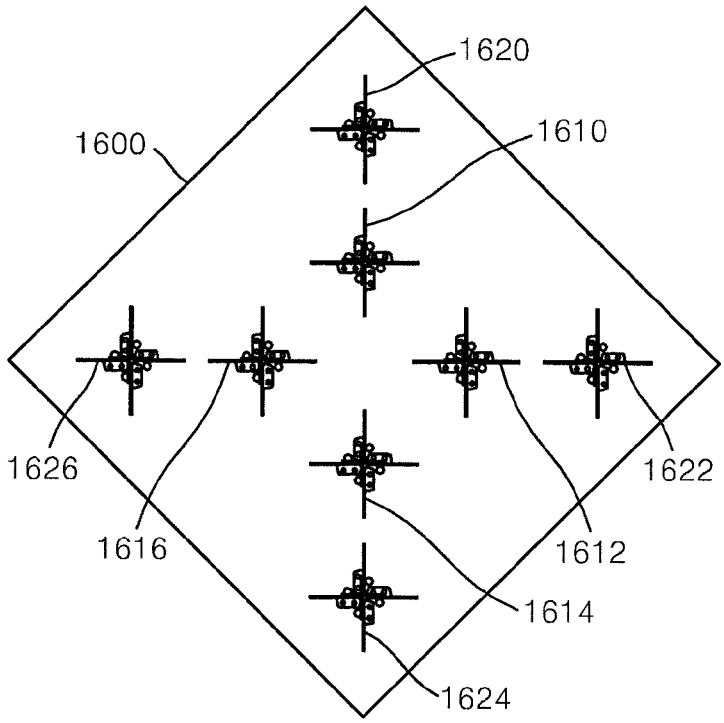
FIG. 16 illustrates the shape in which additional complex elements are disposed between each of complex elements and vertices of a first reflective patch element, as illustrated in the dipole array circular polarization antenna illustrated in FIG. 12A.
Figure 17:
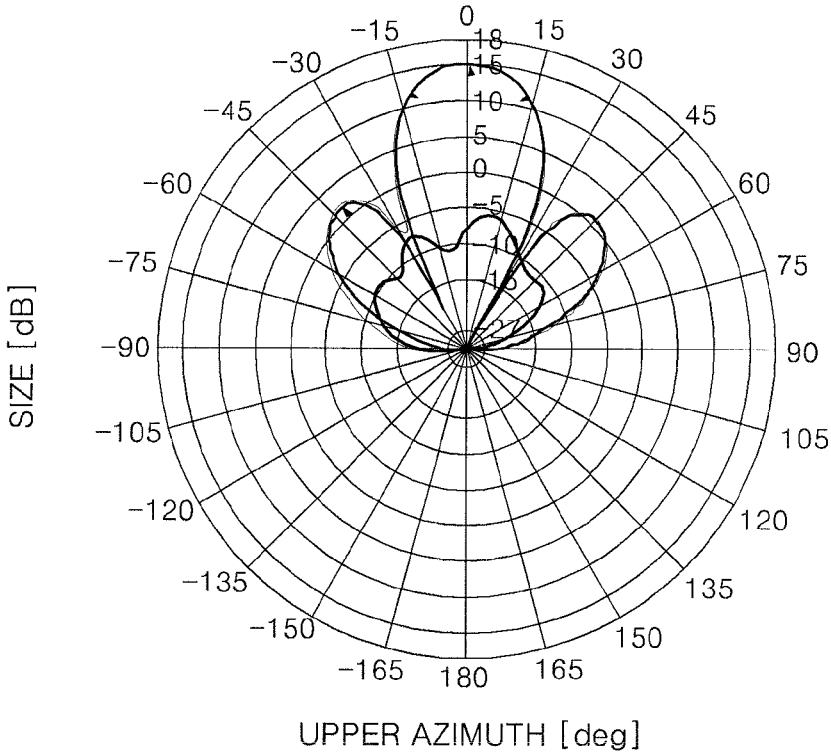
FIG. 17 illustrates a horizontal radiation pattern having the arrangement shape of FIG. 16.

FIG. 16 illustrates the shape in which additional complex elements 1620, 1622, 1624, and 1626 are disposed between each of complex elements 1610, 1612, 1614, 1616 and vertices of a first reflective patch element 1600, as illustrated in the dipole array circular polarization antenna illustrated in FIG. 12A. The arrangement shape of FIG. 16 is a loop arrangement and applies to a link antenna. In this case, a distance from each of the additional complex elements 1620, 1622, 1624, and 1626 to sidewalls that are closest to the first reflective patch element 1600 is ¼ to ½ of the wavelength λ of the start frequency (Fs) in the usable band. A distance between centers of the additional, adjacent complex elements 1620 and 1622, 1622 and 1624, 1624 and 1626, and 1626 and 1620 may be 1.5 times the wavelength λ of the start frequency (Fs) in the usable band. FIG. 17 illustrates a horizontal radiation pattern in the case when a distance from each of the additional complex elements 1620, 1622, 1624, and 1626 to sidewalls that are closest to the first reflective patch element 1600 is ½ of the wavelength λ of the start frequency (Fs) in the usable band. As illustrated in FIG. 17, a HPBW of the horizontal radiation pattern is about 25°. This means that, when compared to the horizontal radiation pattern of FIG. 13, the HPBW is narrowed to approximately half or more. Thus, a gain is increased to 3 dB or more.

In the case of a feeding method of the dipole array circular polarization antenna illustrated in FIG. 16, a feeding method to the four complex elements 1610, 1612, 1614, and 1616 positioned at vertices of a diamond shape is the same as the feeding methods of the dipole array circular polarization antenna illustrated in FIGS. 12A and 12B. A feeding operation is performed on each of the additional complex elements 1620, 1622, 1624, and 1626 in the same method as that of the complex elements that are closest to each of the additional complex elements 1620, 1622, 1624, and 1626, among the four complex elements 1610, 1612, 1614, and 1616 positioned at the vertices of the diamond shape.

Figure 18A:
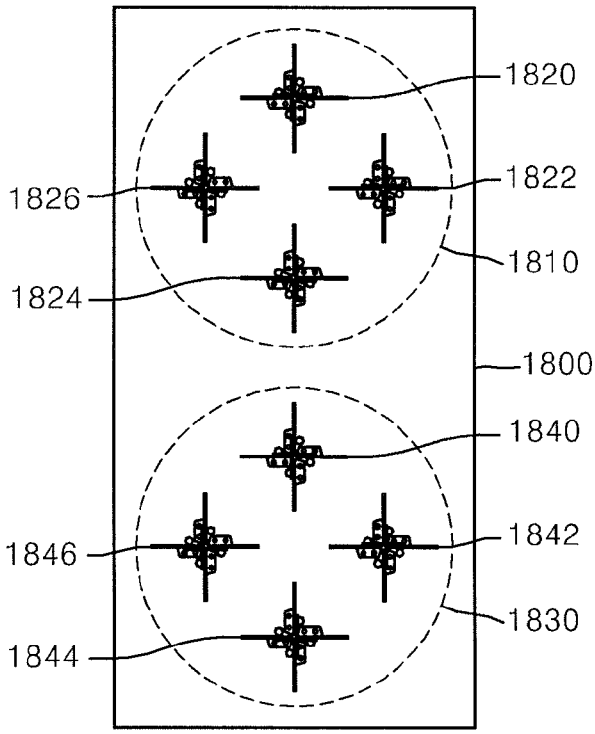
FIGS. 18A and 18B illustrate the vertical arrangement shape of each of complex elements used in a service antenna.
Figure 18B:
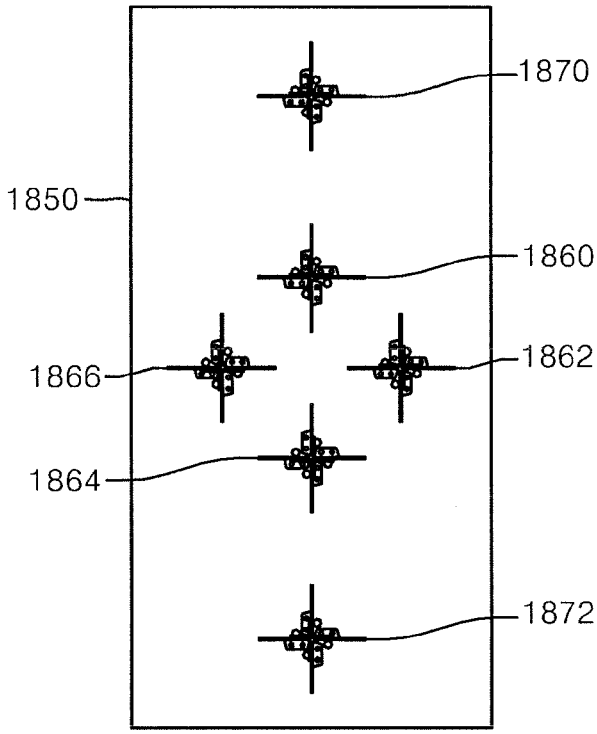
Figure 19:
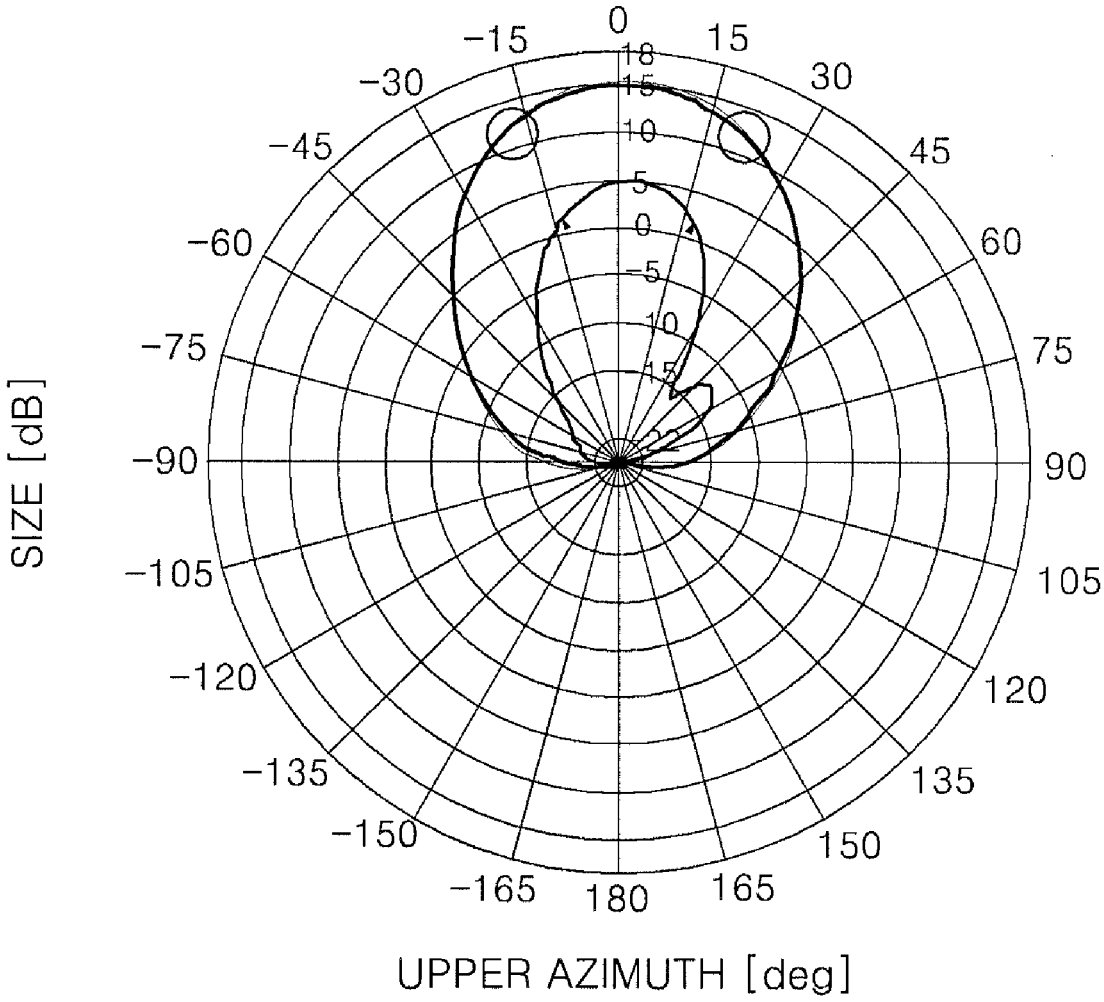
FIG. 19 illustrates a horizontal radiation pattern having the arrangement shape of FIG. 18A.

FIGS. 18A and 18B illustrate the vertical arrangement shape of each of complex elements 1820, 1822, 1824, 1826, 1840, 1842, 1844, and 1846 used in a service antenna. When the dipole array circular polarization antenna is constituted as illustrated in FIGS. 18A and 18B, like in the loop-shaped arrangement, the entire gain is increased to 3 dB or more compared to the dipole array circular polarization antenna illustrated in FIG. 12A and as such, a beam width is relatively reduced. The arrangement shape of the complex elements of FIG. 18A is the same as that of FIG. 12A. Each of complex elements 1820, 1822, 1824, 1826, 1840, 1842, 1844, and 1846 is disposed at vertices of a diamond shape, and a line connecting the upper vertices and the lower vertices of the diamond shape during installation forms a plurality of antenna groups 1810 and 1830 that are perpendicular to the earth's surface. A distance from centers of the remaining elements 1820, 1822, 1826, 1842, 1844, 1846, excluding the complex elements 1824 and 1840 that are closest to another group, from the complex elements 1820, 1822, 1824, 1826, 1840, 1842, 1844, and 1846 of each of the antenna groups 1810 and 1830, to sidewalls that are closest to a first reflective patch element 1800 is ½ of the wavelength λ of the start frequency (Fs) in the usable band. In addition, a distance between terminals of parallel portions of the complex elements 1824 and 1840 that are closest to another antenna group 1810 and 1830 is 1/20 to ⅛ (preferably, 1/16) of the wavelength λ of the start frequency (Fs) in the usable band. The distance is the same as a distance between terminals of parallel portions of the complex elements that are closest to each of the antenna groups 1810 and 1830, among the complex elements 1820, 1822, 1824, 1826, 1840, 1842, 1844, and 1846 of each of the antenna groups 1810 and 1830.

The arrangement shape of the complex elements illustrated in FIG. 18B is formed when additional complex elements are disposed in upper and lower positions of the arrangement shape of FIG. 12A. In this case, each of additional complex elements 1870 and 1872 are disposed between the complex elements 1860 and 1864 that are positioned on a straight line perpendicular to the earth's surface, among the complex elements 1860, 1862, 1864, and 1866 disposed in the form of a diamond, and side surfaces of a first reflective patch element 1850. In addition, a distance between terminals of parallel portions of the additional complex elements 1870 and 1872 and terminals of parallel portions of the complex elements 1860 and 1864 that are closest to each of the additional complex elements 1870 and 1872, among the complex elements 1860, 1862, 1864, and 1866 disposed in the form of the diamond is 1/20 to ⅛ (preferably, 1/16) of the wavelength λ of the start frequency (Fs) in the usable band. The distance is the same as a distance between terminals of parallel portions of the complex elements that are closest to each of the additional complex elements 1870 and 1872, among the complex elements 1860, 1862, 1864, and 1866 disposed in the form of the diamond. In addition, a distance from each of the additional complex elements 1870 and 1872 to sidewalls that are closest to the first reflective patch element 1850 is ½ of the wavelength λ of the start frequency (Fs) in the usable band. In this case, a beam width is extended to about 10° and a HPBW of a horizontal radiation pattern is 55°, and a HPBW of a vertical radiation pattern is about 25° in a frequency band of 2.2 GHz. This is the same as the case when, in the dipole array circular polarization antenna illustrated in FIG. 18A, the complex elements are arranged so that a diagonal distance from the centers of the complex elements to a side portion that is closest to the first reflective patch element 1800 is ½ of the wavelength λ of the start frequency (Fs) in the usable band. A gain is increased to 3 dB or more compared to the dipole array circular polarization antenna illustrated in FIG. 12A.

In a feeding method of the dipole array circular polarization antenna illustrated in FIG. 18A, a feeding method to the complex elements 1810, 1812, 1814, 1816, 1830, 1832, 1834, and 1836 of each of the antenna groups 1810 and 1830 is the same as the feeding methods of the dipole array circular polarization antenna illustrated in FIGS. 12A and 12B. In addition, in the case of a feeding method of the dipole array circular polarization antenna illustrated in FIG. 18B, a feeding method to the complex elements 1860, 1862, 1864, and 1866 positioned at vertices of a diamond shape is the same as the feeding methods of the dipole array circular polarization antenna illustrated in FIGS. 12A and 12B. The same feeding method as the complex elements that are closest to each of the additional complex elements 1870 and 1872, among the four complex elements 1860, 1862, 1864, and 1866 positioned at the vertices of the diamond shape, is used in each of the additional complex elements 1870 and 1872.

In the complex elements for the antenna of the RF repeater and the dipole array circular polarization antenna using the same according to the present invention, side lobes that are radiated to a backward direction of an antenna are minimized and a polarization ratio is increased so that interference due to reflective waves of a main lobe and side lobes that are reflected due to ambient obstacles can be minimized, and a relatively large beam width is formed so that a service area of the antenna can be extended. In addition, a feeding method by which impedance matching and occurrence of circular polarization are simultaneously achieved, is used so that the size of the antenna can be made small and manufacturing costs thereof can be reduced. Furthermore, quality is improved, and installation costs can be reduced when the present invention is applied to a wired optical repeater and an interference removing RF repeater, respectively.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. Complex elements for an antenna of a radio frequency (RF) repeater, the complex elements comprising:

a plurality of radiation members which are separated from one another by a predetermined angular distance and comprises a radiation portion and a leg portion, the radiation portion comprising a pair of parallel portions, which are separated from each other in a vertical direction and are disposed to be parallel to each other, and a connection portion, which is disposed to be perpendicular to the pair of parallel portions and connects ends of each of the pair of parallel portions, and the leg portion extending from the radiation portion; and a plurality of feeding members, each of the feeding members connected to each of the radiation members that face each other, among the plurality of radiation members.

2. The complex elements of claim 1, wherein a length from a bottom end of the leg portion to a top end of a first parallel portion that is positioned in a lower position, of the parallel portions is ¼ of a wavelength λ of a start frequency (Fs) in a usable band of radiation propagation, and a length from a bottom end of the leg portion to a top end of a first parallel portion that is positioned in an upper position, of the parallel portions is ½ of the wavelength λ of the start frequency (Fs) in the usable band of the radiation propagation.

3. The complex elements of claim 2, wherein a length between terminals of the parallel portions positioned in a lower portion of each of the radiation members that face each other, among the plurality of radiation members is ½ of the wavelength λ of the start frequency (Fs) in the usable band of the radiation propagation.

4. The complex elements of claim 2, wherein the radiation members are formed of aluminum (Al) and the feeding members are formed of metal containing copper (Cu).

5. The complex elements of claim 1, wherein a length between terminals of the parallel portions positioned in a lower portion of each of the radiation members that face each other, among the plurality of radiation members is ½ of the wavelength λ of a start frequency (Fs) in the usable band of the radiation propagation.

6. The complex elements of claim 5, wherein a length between terminals of the parallel portions positioned in an upper portion of each of the radiation members that face each other, among the plurality of radiation members is ½ of the wavelength λ of an end frequency (Fe) in the usable band of the radiation propagation.

7. The complex elements of claim 1, wherein a length between terminals of the parallel portions positioned in an upper portion of each of the radiation members that face each other, among the plurality of radiation members is ½ of the wavelength λ of an end frequency (Fe) in the usable band of the radiation propagation.

8. The complex elements of claim 1, wherein the radiation members are formed of aluminum (Al) and the feeding members are formed of metal containing copper (Cu).

9. The complex elements of claim 1, wherein a center of a first feeding member of the feeding members is protruded upwards, and a center of a second feeding member of the feeding members is protruded downwards so that each of the first and second feeding members does not contact.

10. The complex elements of claim 9, wherein the feeding members comprise:

support portions attached to each leg portion of the radiation members that are connected to each other; and connection portions connecting top ends of the support portions, wherein a length from one end of the support portions to centers of the connection portions of the feeding members is ¼ of the wavelength λ of the start frequency (Fs) in the usable band of the radiation propagation.

11. The complex elements of claim 1, wherein the feeding members comprise:

support portions attached to each leg portion of the radiation members that are connected to each other; and connection portions connecting top ends of the support portions, wherein a length from one end of the support portions to centers of the connection portions of the feeding members is ¼ of the wavelength λ of the start frequency (Fs) in the usable band of the radiation propagation.

12. The complex elements of claim 1, wherein the feeding members and the radiation members are connected to one another by using a connection member formed of an insulating material.

13. The complex elements of claim 1, wherein coaxial cables are connected to each of the feeding members connecting the radiation members that face each other, among the plurality of radiation members, and a length of each of the coaxial cables is determined by the following equation $$L = VF \times \frac{\lambda}{4}(n+1),$$

where L is a length of a coaxial cable, VF is a velocity factor of the coaxial cable, and λ is a wavelength of a start frequency (Fs) in a usable band of radiation propagation, and wherein, when n of a first coaxial cable is a (where a is selected from the ground consisting of {1, 3, 5, 7, . . . }, n of a second coaxial cable is a+1.

14. The complex elements of claim 13, wherein each of the coaxial cables is connected to a ¼ wavelength hybrid impedance converter to which a coaxial cable for matching having an impedance of 50° is connected, thereby constituting an impedance matching portion.

15. A dipole array circular polarization antenna in which a plurality of complex elements for an antenna of a radio frequency (RF) repeater are disposed on a bottom surface of a reflective patch element that absorbs and intercepts electronic waves and is formed in a form of a box shape having an opened upper portion, by a predetermined distance, wherein the complex elements comprise:

a plurality of radiation members which are separated from one another by a predetermined angular distance and comprises a radiation portion and a leg portion, the radiation portion comprising a pair of parallel portions, which are separated from each other in a vertical direction and are disposed to be parallel to each other, and a connection portion, which is disposed to be perpendicular to the pair of parallel portions and connects ends of each of the pair of parallel portions, and the leg portion extending from the radiation portion; and a plurality of feeding members, each of the feeding members connected to each of the radiation members that face each other, among the plurality of radiation members.

16. The dipole array circular polarization antenna of claim 15, wherein the complex elements for the antenna of the RF repeater are disposed so that each of shapes connecting central points of the complex elements is a diamond shape, and a distance between centers of the adjacent complex elements for the antenna of the RF repeater is ½ of a wavelength λ of a start frequency (Fs) in a usable band of radiation propagation.

17. The dipole array circular polarization antenna of claim 16, wherein coaxial cables are connected to each of the feeding members connecting the radiation members that face each other, among the plurality of radiation members of each of the complex elements, and a length of each of the coaxial cables is determined by the following equation $$L_{ij} = VF \times \frac{\lambda}{4}(n + i + j - 1),\ n = 1,3,5,7\Lambda,\ i = 1,2,3,\Lambda,\ j = 1,2,$$

where $L_{ij}$ is the length of the coaxial cable (where i is a sequence in which each of the complex elements is disposed in the form of a diamond clockwise or counterclockwise, and j is a sequence in which the coaxial cable is connected to each of the complex elements clockwise or counterclockwise), and VF is a velocity factor of the coaxial cable, and λ is a wavelength of radiation propagation, and wherein, the length of each of the coaxial cables connected to the complex elements sequentially increases clockwise or counterclockwise.

18. The dipole array circular polarization antenna of claim 17, wherein each of the coaxial cables is connected to a ¼ wavelength hybrid impedance converter to which a coaxial cable for matching having an impedance of 50Ω is connected, thereby constituting an impedance matching portion.

19. The dipole array circular polarization antenna of claim 17, wherein the complex elements for the antenna of the RF repeater are disposed so that each of shapes connecting central points of the complex elements is a diamond shape, and a distance from center of each of complex elements for the antenna of the RF repeater to sidewalls that are closest to the reflective patch element, is ¼ to ½ of the wavelength λ of the start frequency (Fs) in the usable band of the radiation propagation.

20. The dipole array circular polarization antenna of claim 17, wherein each of the complex elements for the antenna of the RF repeater is disposed so that a line extending parallel portions of each of the radiation members has an angle of 45° or 135° with respect to sidewalls of the reflective patch element.

21. The dipole array circular polarization antenna of claim 20, wherein additional complex elements for an antenna of an RF repeater are disposed between each of the complex elements for the antenna of the RF repeater and vertices of the reflective patch element, and a distance between centers of the adjacent, additional complex elements is 1.5 times the wavelength λ of the start frequency (Fs) in the usable band of the radiation propagation.

22. The dipole array circular polarization antenna of claim 17, wherein additional complex elements for an antenna of an RF repeater are disposed between each of the complex elements for the antenna of the RF repeater and vertices of the reflective patch element, and a distance between centers of the adjacent, additional complex elements is 1.5 times the wavelength λ of the start frequency (Fs) in the usable band of the radiation propagation.

23. The dipole array circular polarization antenna of claim 17, wherein each of the complex elements for the antenna of the RF repeater is disposed so that a line extending parallel portions of each of the radiation members is parallel to or perpendicular to sidewalls of the reflective patch element.

24. The dipole array circular polarization antenna of claim 23, wherein each of additional complex elements for an antenna of an RF repeater is disposed on a straight line connecting centers of the complex elements that face each other, among the complex elements for the antenna of the RF repeater, and a distance between terminals of parallel portions that are positioned in a lower position of each of the additional complex elements and terminals of parallel portions of the complex elements that are closest to each of the additional complex elements, among the complex elements for the antenna of the RF repeater is ⅛ to ¼ of the wavelength λ of the start frequency (Fs) in the usable band of the radiation propagation.

25. The dipole array circular polarization antenna of claim 23, wherein each of additional complex elements for an antenna of an RF repeater is disposed on a straight line connecting centers of the complex elements that face each other, among the complex elements for the antenna of the RF repeater, and a distance from center of each of the additional complex elements to sidewalls that are closest to the reflective patch element, is ¼ to ½ of the wavelength λ of the start frequency (Fs) in the usable band of the radiation propagation.

26. The dipole array circular polarization antenna of claim 17, wherein each of additional complex elements for an antenna of an RF repeater is disposed on a straight line connecting centers of the complex elements that face each other, among the complex elements for the antenna of the RF repeater, and a distance between terminals of parallel portions that are positioned in a lower position of each of the additional complex elements and terminals of parallel portions of the complex elements that are closest to each of the additional complex elements, among the complex elements for the antenna of the RF repeater is ⅛ to ¼ of the wavelength λ of the start frequency (Fs) in the usable band of the radiation propagation.

27. The dipole array circular polarization antenna of claim 17, wherein each of additional complex elements for an antenna of an RF repeater is disposed on a straight line connecting centers of the complex elements that face each other, among the complex elements for the antenna of the RF repeater, and a distance from center of each of the additional complex elements to sidewalls that are closest to the reflective patch element, is ¼ to ½ of the wavelength λ of the start frequency (Fs) in the usable band of the radiation propagation.

28. The dipole array circular polarization antenna of claim 17, wherein the complex elements for the antenna of the RF repeater are disposed so that each of shapes connecting central points of the complex elements is a diamond shape, and the complex elements form a plurality of antenna groups in which a distance between centers of the adjacent complex elements is ½ of the wavelength λ of the start frequency (Fs) in the usable band of the radiation propagation, and a distance between terminals of parallel portions that are positioned in a lower position of the radiation members of each of the complex elements that belong to different antenna groups and have the closest distance between their centers is 1/20 to ⅛ of the wavelength λ of the start frequency (Fs) in the usable band of the radiation propagation.

29. The dipole array circular polarization antenna of claim 16, wherein the complex elements for the antenna of the RF repeater are disposed so that each of shapes connecting central points of the complex elements is a diamond shape, and a distance from center of each of complex elements for the antenna of the RF repeater to sidewalls that are closest to the reflective patch element, is ¼ to ½ of the wavelength λ of the start frequency (Fs) in the usable band of the radiation propagation.

30. The dipole array circular polarization antenna of claim 16, wherein each of the complex elements for the antenna of the RF repeater is disposed so that a line extending parallel portions of each of the radiation members has an angle of 45° or 135° with respect to sidewalls of the reflective patch element.

31. The dipole array circular polarization antenna of claim 16, wherein additional complex elements for an antenna of an RF repeater are disposed between each of the complex elements for the antenna of the RF repeater and vertices of the reflective patch element, and a distance between centers of the adjacent, additional complex elements is 1.5 times the wavelength λ of the start frequency (Fs) in the usable band of the radiation propagation.

32. The dipole array circular polarization antenna of claim 16, wherein each of the complex elements for the antenna of the RF repeater is disposed so that a line extending parallel portions of each of the radiation members is parallel to or perpendicular to sidewalls of the reflective patch element.

33. The dipole array circular polarization antenna of claim 16, wherein each of additional complex elements for an antenna of an RF repeater is disposed on a straight line connecting centers of the complex elements that face each other, among the complex elements for the antenna of the RF repeater, and a distance between terminals of parallel portions that are positioned in a lower position of each of the additional complex elements and terminals of parallel portions of the complex elements that are closest to each of the additional complex elements, among the complex elements for the antenna of the RF repeater is ⅛ to ¼ of the wavelength λ of the start frequency (Fs) in the usable band of the radiation propagation.

34. The dipole array circular polarization antenna of claim 16, wherein each of additional complex elements for an antenna of an RF repeater is disposed on a straight line connecting centers of the complex elements that face each other, among the complex elements for the antenna of the RF repeater, and a distance from center of each of the additional complex elements to sidewalls that are closest to the reflective patch element, is ¼ to ½ of the wavelength λ of the start frequency (Fs) in the usable band of the radiation propagation.

35. The dipole array circular polarization antenna of claim 16, wherein the complex elements for the antenna of the RF repeater are disposed so that each of shapes connecting central points of the complex elements is a diamond shape, and the complex elements form a plurality of antenna groups in which a distance between centers of the adjacent complex elements is ½ of the wavelength λ of the start frequency (Fs) in the usable band of the radiation propagation, and a distance between terminals of parallel portions that are positioned in a lower position of the radiation members of each of the complex elements that belong to different antenna groups and have the closest distance between their centers is 1/20 to ⅛ of the wavelength λ of the start frequency (Fs) in the usable band of the radiation propagation.

36. The dipole array circular polarization antenna of claim 15, wherein the complex elements for the antenna of the RF repeater are disposed so that each of shapes connecting central points of the complex elements is a diamond shape, and a distance from center of each of complex elements for the antenna of the RF repeater to sidewalls that are closest to the reflective patch element, is ¼ to ½ of the wavelength λ of the start frequency (Fs) in the usable band of the radiation propagation.

37. The dipole array circular polarization antenna of claim 15, wherein each of the complex elements for the antenna of the RF repeater is disposed so that a line extending parallel portions of each of the radiation members has an angle of 45° or 135° with respect to sidewalls of the reflective patch element.

38. The dipole array circular polarization antenna of claim 15, wherein additional complex elements for an antenna of an RF repeater are disposed between each of the complex elements for the antenna of the RF repeater and vertices of the reflective patch element, and a distance between centers of the adjacent, additional complex elements is 1.5 times the wavelength λ of the start frequency (Fs) in the usable band of the radiation propagation.

39. The dipole array circular polarization antenna of claim 15, wherein each of the complex elements for the antenna of the RF repeater is disposed so that a line extending parallel portions of each of the radiation members is parallel to or perpendicular to sidewalls of the reflective patch element.

40. The dipole array circular polarization antenna of claim 15, wherein each of additional complex elements for an antenna of an RF repeater is disposed on a straight line connecting centers of the complex elements that face each other, among the complex elements for the antenna of the RF repeater, and a distance between terminals of parallel portions that are positioned in a lower position of each of the additional complex elements and terminals of parallel portions of the complex elements that are closest to each of the additional complex elements, among the complex elements for the antenna of the RF repeater is ⅛ to ¼ of the wavelength λ of the start frequency (Fs) in the usable band of the radiation propagation.

41. The dipole array circular polarization antenna of claim 15, wherein each of additional complex elements for an antenna of an RF repeater is disposed on a straight line connecting centers of the complex elements that face each other, among the complex elements for the antenna of the RF repeater, and a distance from center of each of the additional complex elements to sidewalls that are closest to the reflective patch element, is ¼ to ½ of the wavelength λ of the start frequency (Fs) in the usable band of the radiation propagation.

42. The dipole array circular polarization antenna of claim 15, wherein the complex elements for the antenna of the RF repeater are disposed so that each of shapes connecting central points of the complex elements is a diamond shape, and the complex elements form a plurality of antenna groups in which a distance between centers of the adjacent complex elements is ½ of the wavelength λ of the start frequency (Fs) in the usable band of the radiation propagation, and a distance between terminals of parallel portions that are positioned in a lower position of the radiation members of each of the complex elements that belong to different antenna groups and have the closest distance between their centers is 1/20 to ⅛ of the wavelength λ of the start frequency (Fs) in the usable band of the radiation propagation.

43. The dipole array circular polarization antenna of claim 15, wherein each of the complex elements for the antenna of the RF repeater is disposed on a straight line, and a distance between centers of adjacent complex elements is ¼ to ½ of the wavelength λ of the start frequency (Fs) in the usable band of the radiation propagation.

44. The dipole array circular polarization antenna of claim 43, wherein a distance between centers of the complex elements to sidewalls that are closest to the reflective patch element is ¼ to ½ of the wavelength λ of the start frequency (Fs) in the usable band of the radiation propagation.

* * * * *